US006945761B1

(12) United States Patent
Nishio et al.

(10) Patent No.: US 6,945,761 B1
(45) Date of Patent: Sep. 20, 2005

(54) FLUID APPARATUS HAVING DOWNWARDLY INCLINED LOWER LAMELLA PORTION OF A BELLOWS

(75) Inventors: Kiyoshi Nishio, Sanda (JP); Makoto Fujii, Sanda (JP); Masayoshi Katsura, Sanda (JP); Hitoshi Kawamura, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 0 days.

(21) Appl. No.: 09/868,938

(22) PCT Filed: Nov. 20, 2000

(86) PCT No.: PCT/JP00/08159

§ 371 (c)(1),
(2), (4) Date: Jul. 18, 2001

(87) PCT Pub. No.: WO01/40651

PCT Pub. Date: Jun. 7, 2001

(30) Foreign Application Priority Data

Nov. 29, 1999 (JP) ..... 11-337562

(51) Int. Cl.[7] ..... F04B 43/00; F01B 3/00
(52) U.S. Cl. ..... 417/472; 92/34
(58) Field of Search ..... 417/472; 92/34; 91/34

(56) References Cited

U.S. PATENT DOCUMENTS 2,021,156 A * 11/1935 Smith ..... 417/472
3,394,631 A * 7/1968 Thompson ..... 92/46
4,231,724 A * 11/1980 Hope et al. ..... 417/472
4,655,690 A * 4/1987 Boedecker et al. ..... 417/472
4,984,970 A * 1/1991 Eickmann ..... 417/472
6,345,963 B1 * 2/2002 Thomin et al. ..... 417/472

FOREIGN PATENT DOCUMENTS

| | | | |
|---|---|---|---|
| JP | 3-179184 | 8/1991 | |
| JP | 6-17752 | 1/1994 | |
| JP | 7-279851 | 10/1995 | |
| JP | 8-159016 | 6/1996 | |
| WO | WO 99/31388 | * 6/1999 | ..... 417/472 |

* cited by examiner

*Primary Examiner*—Cheryl Tyler
*Assistant Examiner*—Timothy P. Solak
(74) *Attorney, Agent, or Firm*—Bacon & Thomas

(57) ABSTRACT

A bellows that is extendingly and contractingly deformable in the axial direction is placed in a pump body and forms a liquid chamber inside the bellows. A suction portion and a discharge portion are formed in an inner bottom face of the pump body facing the liquid chamber. Liquid is sucked from the suction port into the liquid chamber by extension of the bellows, and the liquid in the liquid chamber is discharged from the discharge portion by contraction of the bellows. The extending and contracting portion of the bellows which is configured by forming ridge-like folds and valley-like folds in a vertically alternate and continuous manner is formed into a shape in which the lower one of upper and lower lamella portions of each of the ridge-like folds, or the lower lamella portion is inclined downwardly toward the axis defining the axial direction, not only in an extending state but also in a contracting state. Even in the case where liquid containing a sedimenting material such as slurry is used, therefore, the sedimenting material can be prevented from sedimenting and stagnating in the extending and contracting portion of the bellows.

6 Claims, 17 Drawing Sheets

FLUID APPARATUS HAVING DOWNWARDLY INCLINED LOWER LAMELLA PORTION OF A BELLOWS

TECHNICAL FIELD

The present invention relates to a fluid apparatus which has a bellows, and which is typified by a bellows type pump and an accumulator for reducing pulsations of such a pump.

BACKGROUND ART

As a pump for circulating and transporting chemical liquid in various processes such as washing of surfaces of ICs or liquid crystal display devices in a semiconductor producing apparatus, used is a bellows type pump in which no particles are generated as a result of the pumping operation (for example, Japanese Patent Application Laying-Open No. 3-179184). In a pump of this kind, pulsations are produced by reciprocal motion due to extension and contraction of the bellows. In order to reduce the pulsations, therefore, also an accumulator is used (for example, Japanese Patent Application Laying-Open No. 6-17752).

In such a pump having a bellows, or an accumulator, there arises no problem when chemical liquids or pure water are used as transported liquid. However, a problem is produced in the case where abrasive liquid containing slurry such as silica is used as a polishing solution for Chemical Mechanical Polishing (CMP) of a semiconductor wafer, a hard disk which is to be incorporated into a computer, and the like. Namely, ridge-like folds of a bellows are formed so as to elongate in a direction perpendicular to the axis of the bellows in the contracting state. In the case where liquid containing a material such as slurry which easily sediments is used, therefore, the sedimenting material collects and sets on the inner sides of the ridge-like folds of the bellows, thereby producing problems such as that the set material causes the bellows to be broken, and that, even in the case where the bellows is not broken, sedimentation collects and aggregates and the shape of particles of the sedimentation is changed from that of the initial stage, thereby adversely affecting polishing.

The invention has been conducted in order to solve the problems. It is an object of the invention to provide a fluid apparatus which has a bellows, which is configured by a pump or an accumulator, and in which, even in the case where transported liquid containing a sedimenting material such as slurry is used, the sedimenting material can be prevented from stagnating and collecting in an extending and contracting portion of the bellows.

SUMMARY OF THE INVENTION

It is an object of the invention to provide a fluid apparatus which has a bellows, which is configured by a pump or an accumulator, and in which, even in the case where transported liquid containing a sedimenting material such as slurry is used, the sedimenting material can be prevented from stagnating and collecting in an extending and contracting portion of the bellows.

The fluid apparatus having a bellows according to the invention is a fluid apparatus configured by a pump in which a bellows that has an extending and contracting portion configured by forming ridge-like folds and valley-like folds in a vertically alternate and continuous manner, and that is extendingly and contractingly deformable in an axial direction is placed in a pump body with setting an axis vertical to be driven to perform extending and contracting deformation, and form a liquid chamber inside the bellows, a suction port and a discharge port are formed in an inner bottom face of the pump body facing the liquid chamber, liquid is sucked from the suction port into the liquid chamber by extension of the bellows, and the liquid in the liquid chamber is discharged from the discharge port by contraction of the bellows. In the fluid apparatus, the extending and contracting portion of the bellows is formed into a shape in which a lower one of upper and lower lamella portions of each of the ridge-like folds is downward inclined as moving toward the axis, not only in an extending state but also in a contracting state.

In the thus configured pump, the axis of the bellows in the pump body is set to be vertical, and the lower lamella portion of each of the ridge-like folds in the bellows is formed into a shape in which the portion is downward inclined as moving toward the axis in both the contracting and extending states. Even in the case where liquid containing a sedimenting material such as slurry is used, therefore, the sedimenting material can be prevented from sedimenting and stagnating inside the ridge-like folds of the bellows.

The other fluid apparatus having a bellows according to the invention is a fluid apparatus configured by an accumulator in which a bellows that has an extending and contracting portion configured by forming ridge-like folds and valley-like folds in a vertically alternate and continuous manner, and that is extendingly and contractingly deformable in an axial direction is placed in an accumulator body with setting an axis vertical to form a liquid chamber inside the bellows and an air chamber outside the bellows, an inflow port and an outflow port are formed in an inner bottom face of the accumulator body facing the liquid chamber, and a liquid pressure in the liquid chamber balances with an air pressure in the air chamber. In the fluid apparatus, the extending and contracting portion of the bellows is formed into a shape in which a lower one of upper and lower lamella portions of each of the ridge-like folds is downward inclined as moving toward the axis, not only in an extending state but also in a contracting state.

In the thus configured accumulator, in the same manner as the pump described above, the axis of the bellows in the accumulator body is set to be vertical, and the lower lamella portion of each of the ridge-like folds in the bellows bellows is formed into a shape in which the portion is downward inclined as moving toward the axis in both the contracting and extending states. Even in the case where liquid containing a sedimenting material such as slurry is used, therefore, the sedimenting material can be prevented from sedimenting and stagnating inside the ridge-like folds of the bellows.

DESCRIPTION OF THE PREFERRED EMBODIMENT

Figure 1:
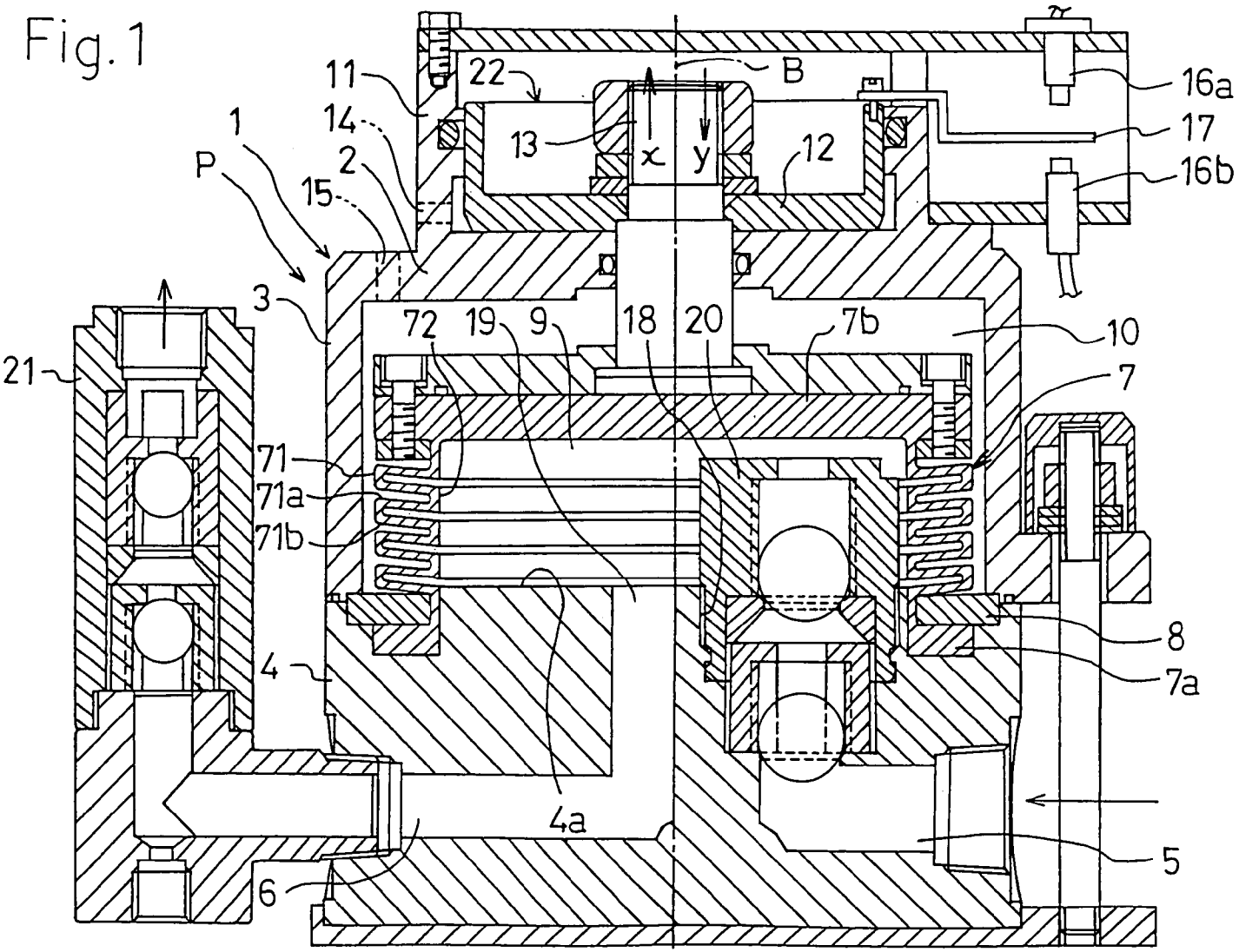
FIG. 1 is a longitudinal sectional front overall view of a pump of a first embodiment.

FIG. 1 shows a first embodiment in which the fluid apparatus having a bellows of the invention is applied to a pump.

Referring to FIG. 1, 1 denotes the pump body having: a cylindrical casing 3 in which an upper end is closed by an upper wall 2; and a bottom wall 4 which airtightly closes an open lower end of the casing 3. A liquid inflow passage 5 and a liquid outflow passage 6 are formed in the bottom wall 4.

A bottomed cylindrical bellows 7 which is extendingly and contractingly deformable in a direction of the axis B is placed in the casing 3 with setting the axis B vertical. The bellows 7 is molded by a fluororesin which has excellent heat and chemical resistances, such as PTFE or PFA. A lower opening peripheral edge 7*a* of the bellows is airtightly pressingly fixed to an upper side face of the bottom wall 4 by an annular fixing plate 8, whereby the inner space of the pump body 1 is partitioned into a liquid chamber 9 inside the bellows 7, and an air chamber 10 outside the bellows 7.

The pump body 1 comprises a reciprocal driving device 22 which drives the bellows 7 to extend and contract. In the reciprocal driving device 22, a cylinder 11 is formed on the side of the upper face of the upper wall 2 of the pump body 1 so that the axis of the cylinder coincides with the axis B of the bellows 7, and a piston 12 which reciprocates in the cylinder 11 is coupled to a center portion of a closed upper end portion 7*b* of the bellows 7 via a piston rod 13 which is passed through the upper wall 2. Pressurized air which is fed from a pressurized air supplying device (not shown) such as a compressor is supplied alternately to the interior of the cylinder 11 and the air chamber 10 through air holes 14 and 15 which are formed respectively in the cylinder 11 and the upper wall 2. Namely, proximity sensors 16*a* and 16*b* are attached to the cylinder 11, and a sensor sensing member 17 is attached to the piston 12. In accordance with the reciprocal motion of the piston 12, the sensor sensing member 17 alternately approaches the proximity sensors 16*a* and 16*b*, whereby the supply of the pressurized air which is fed from the pressurized air supplying device into the cylinder 11, and that into the air chamber 10 are automatically alternately switched over.

A suction port 18 and a discharge port 19 are opened in the inner bottom face 4*a* of the bottom wall 4 which faces the liquid chamber 9 so as to communicate with the inflow passage 5 and the outflow passage 6, respectively. A suction check valve 20 is disposed in the suction port 18, and a discharge check valve 21 is disposed in the outflow passage 6.

Figure 2:
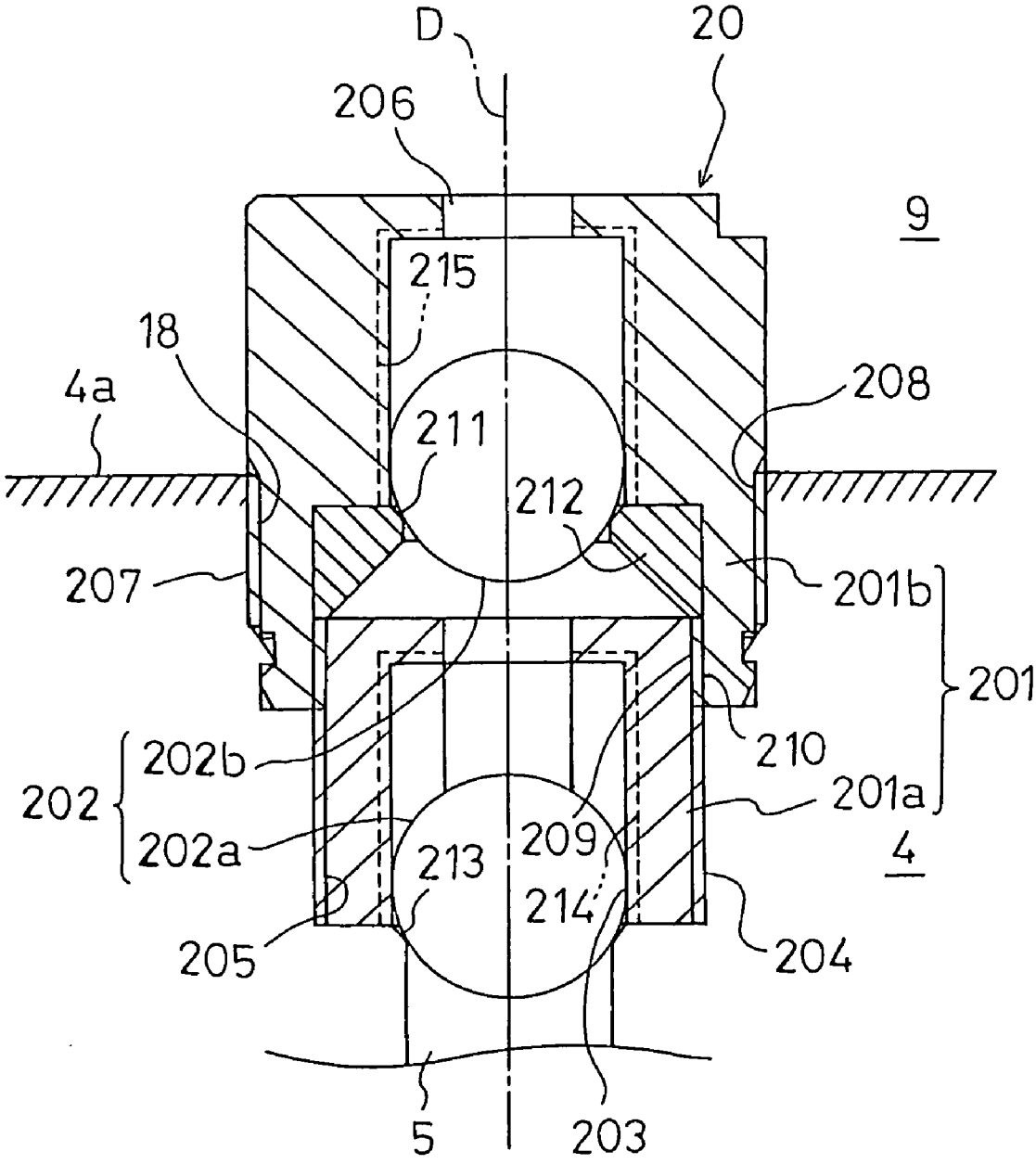
FIG. 2 is a section view of a suction check valve incorporated into the pump of the first embodiment.

As shown in FIG. 2, the suction check valve 20 is configured by a cylindrical valve casing 201 and valve elements 202 each formed by a ball. The valve casing 201 is firmly fixed to the suction port 18 with setting the axis D of the casing vertical, by screwing, engaging means, etc. The illustrated suction check valve 20 has a structure in which the valve elements 202 are vertically arranged in two stages. The valve casing 201 is divided into vertical halves or a first valve casing 201*a* and a second valve casing 201*b*. A first valve element 202*a* and a second valve element 202*b* are disposed in the first valve casing 201*a* and the second valve casing 201*b*, respectively.

The first valve casing 201*a* is formed into a cylindrical shape, and an inlet 203 is opened in the lower end. An external thread portion 204 which is disposed in the outer periphery of the casing is screwed into an internal thread portion 205 which is disposed in a lower step side of the inner periphery of the suction port 18 of the bottom wall 4, whereby the first valve casing is fixed to the bottom wall 4 with setting the axis D vertical.

The second valve casing 201*b* is formed into a cylindrical shape which is larger in diameter than the first valve casing 201*a*, and an outlet 206 is opened in the upper end. An external thread portion 207 which is disposed in the outer periphery of the lower end of the casing is screwed into an internal thread portion 208 which is disposed in an upper step side of the inner periphery of the suction port 18 of the bottom wall 4 so that the diameter is larger than the inner diameter of the internal thread portion 205, and an internal thread portion 209 disposed in the outer periphery of the lower end thereof is screwed onto an external thread portion 210 of the upper end of the outer periphery of the first valve casing 201*a*, whereby the second valve-casing is fixed to the bottom wall 4 so as to be concentrical with the first valve casing 201*a* and protrude into the liquid chamber 9. In this case, a valve seat element 212 having a valve seat 211 is incorporated between the upper end of the first valve casing 201*a* and the lower end of the inner periphery of the second valve casing 201*b*. A valve seat 213 is disposed in an open end of the inflow passage 5 which faces the inlet 203 in the lower end of the first valve casing 201*a*. The first and second valve casings 201*a* and 201*b*, and the first and second valve elements 202*a* and 202*b* are molded by the same material as the bellows 7, or a fluororesin which has excellent heat and chemical resistances, such as PTFE or PFA.

Figure 3:
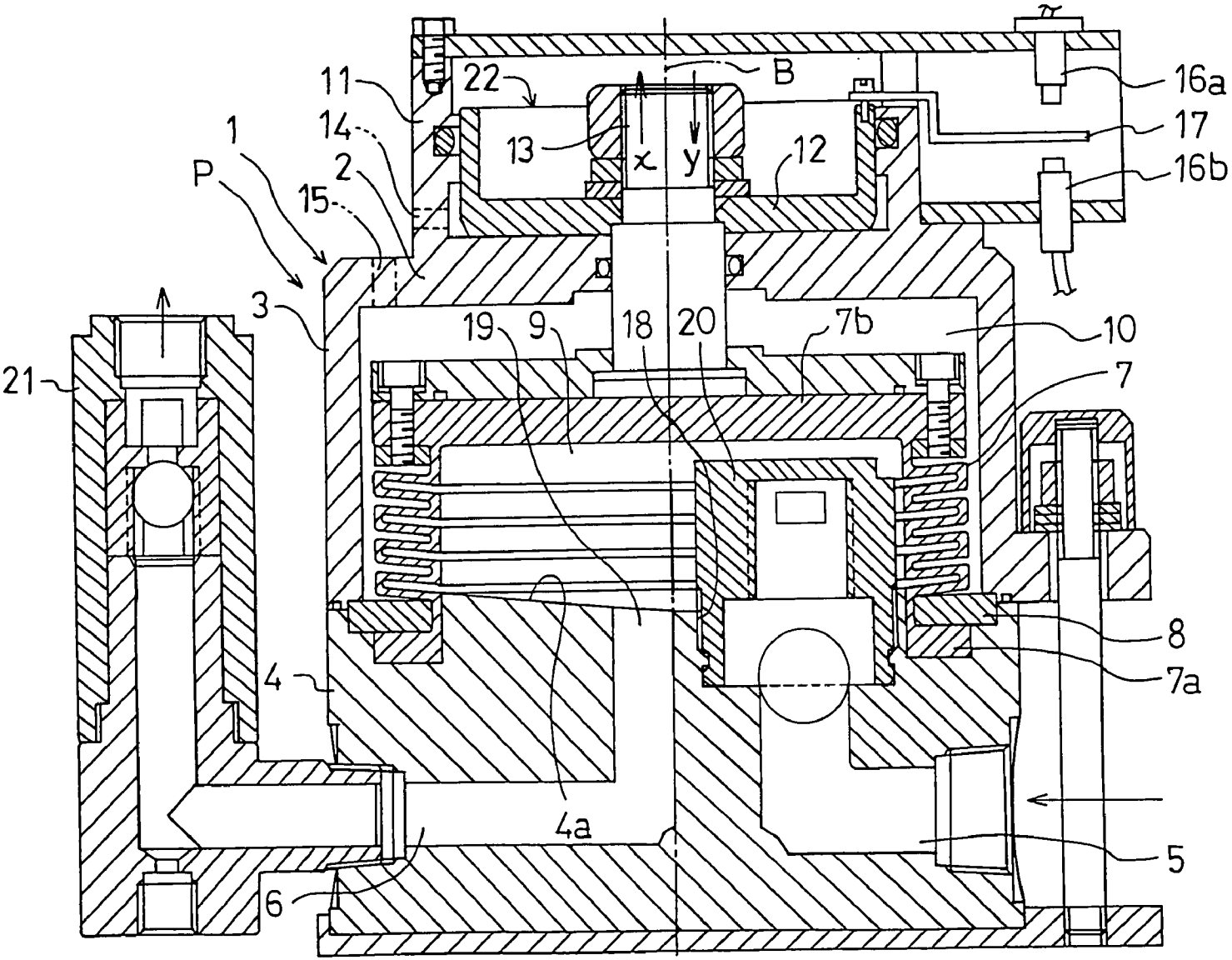
FIG. 3 is a longitudinal sectional front overall view showing another modification of the pump of the first embodiment.
Figure 4:
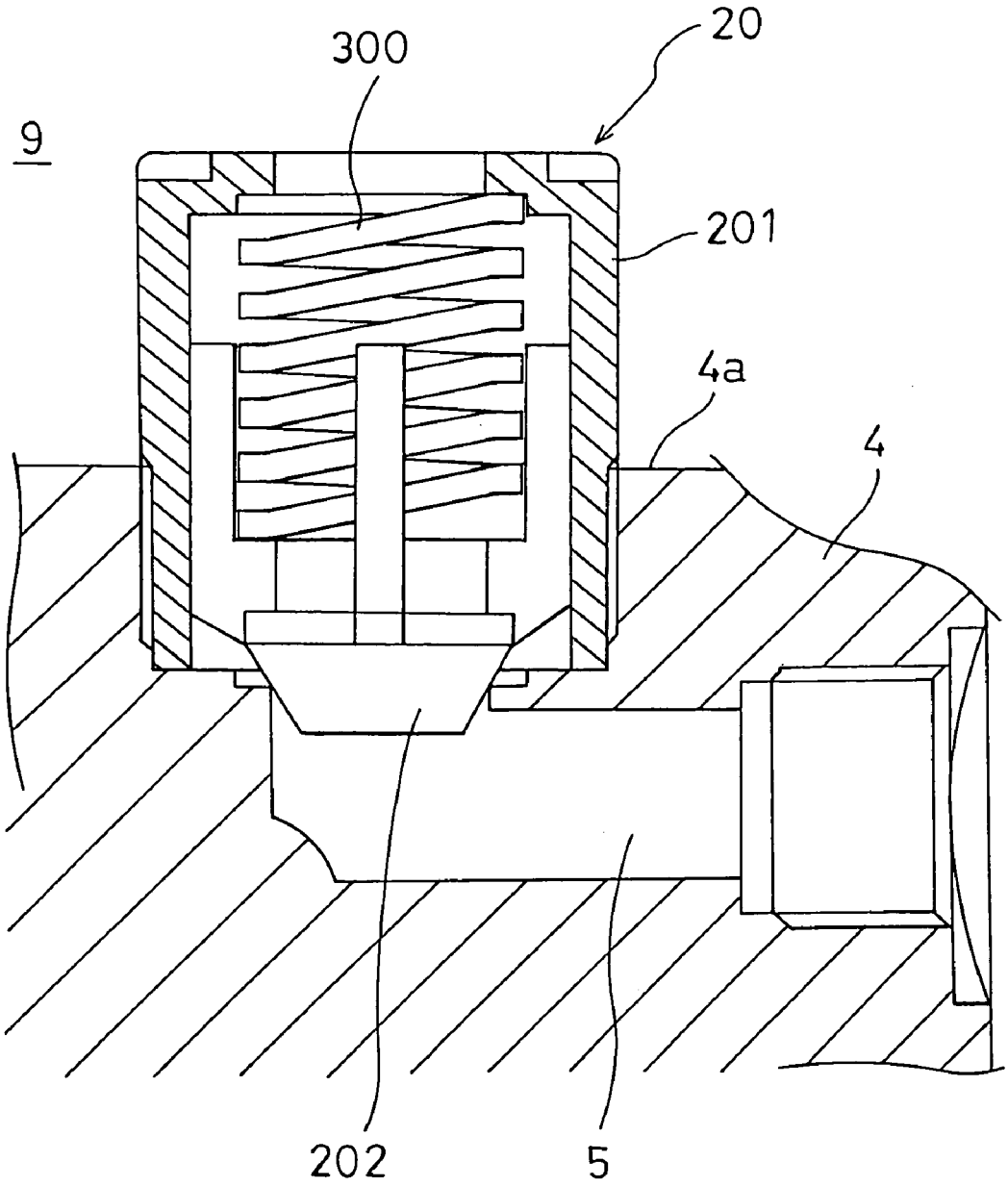
FIG. 4 is a section view showing another modification of the suction check valve to be incorporated into the pump of the first embodiment.

According to this configuration, the first valve element 202*a* is caused by its own weight to be closely contacted with the valve seat 213 in the first valve casing 201*a*, and the second valve element 202*b* is caused by its own weight to be closely contacted with the valve seat 211 in the second valve casing 201*b*, thereby preventing liquid from reversely flowing. When liquid is to be sucked, the first and second valve elements 202*a* and 202*b* are respectively upward separated from the valve seats 213 and 211, to open the valve, and the liquid supplied from the inflow passage 5 is sucked into the liquid chamber 9 from the outlet 206 of the second valve casing 201*b* with passing between a vertical groove 214 formed in the inner periphery of the first valve casing 201*a* and the first valve element 202*a*, and a vertical groove 215 formed in the inner periphery of the second valve casing 201*b* and the second valve element 202*b*. Also in the discharge check valve 21, in the same manner as the structure of the suction check valve 20, valve elements are vertically arranged in two stages in a valve casing which can be divided into vertical halves. As described above, each of the suction check valve 20 and the discharge check valve 21 comprises the valve elements vertically arranged in two stages to constitute a double closing structure. This structure is advantageous because quantitative supply of the transported liquid can be ensured. However, the valves are not restricted to such a double closing structure. As shown in FIG. 3, both or one of the suction check valve 20 and the discharge check valve 21 is configured by a single valve element. The suction check valve 20 and the discharge check valve 21 may be employed that, in place of the valve structure due to the gravity type balls, are configured by a valve structure in which, as shown in FIG. 4, the valve element 202 and a spring 300 for urging the valve element 202 against a valve seat are incorporated into the valve casing 201.

When the pressurized air which is fed from the pressurized air supplying device (not shown) such as a compressor is supplied to the interior of the cylinder 11 via the air hole 14, the piston 12 is raised in the direction x in FIG. 1, and the bellows 7 extends in the same direction to suck the transported liquid in the inflow passage 5 into the liquid chamber 9 via the suction check valve 20. When the pressurized air is supplied into the air chamber 10 via the air hole 15 and air is discharged through the air hole 14, the piston 12 is lowered in the direction y in FIG. 1, and the bellows 7 contracts in the same direction to discharge the transported liquid in the liquid chamber 9 via the discharge check valve 21. When the bellows 7 is driven to perform extending and contracting deformation by the reciprocal motion of the piston 12 in the cylinder 11 as described above, the suction check valve 20 and the discharge check valve 21 are alternately opened and closed, so that suction of the transported liquid from the inflow passage 5 into the liquid chamber 9, and discharge of the transported liquid from the liquid chamber 9 to the outflow passage 6 are alternately repeated to conduct a predetermined pumping action.

Figure 5A:
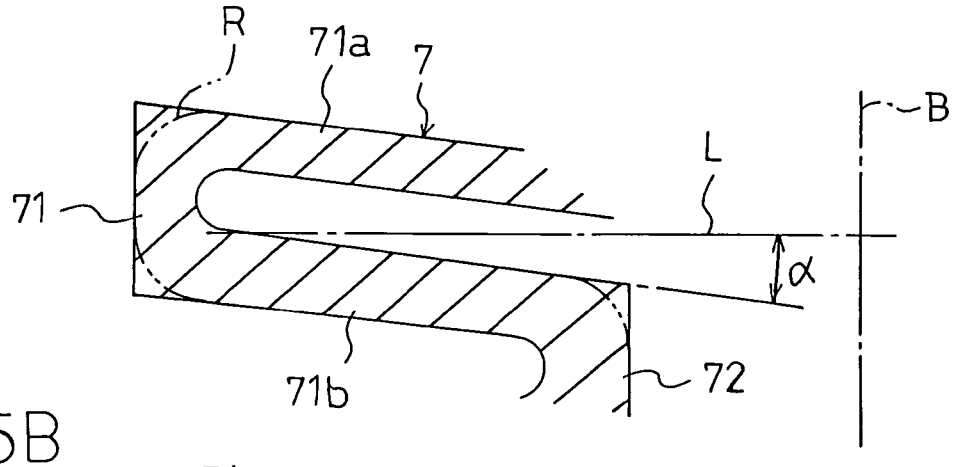
FIG. 5A is an enlarged section view of an extending and contracting portion of a bellows of the pump of the first embodiment.
Figure 5B:
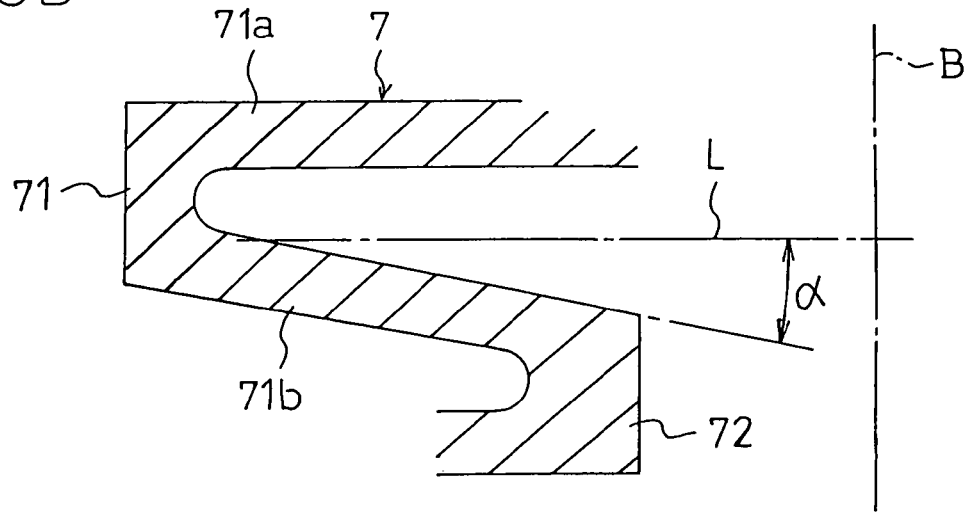
FIG. 5B is an enlarged section view showing another modification of the extending and contracting portion of the bellows of the pump of the first embodiment.
Figure 5C:
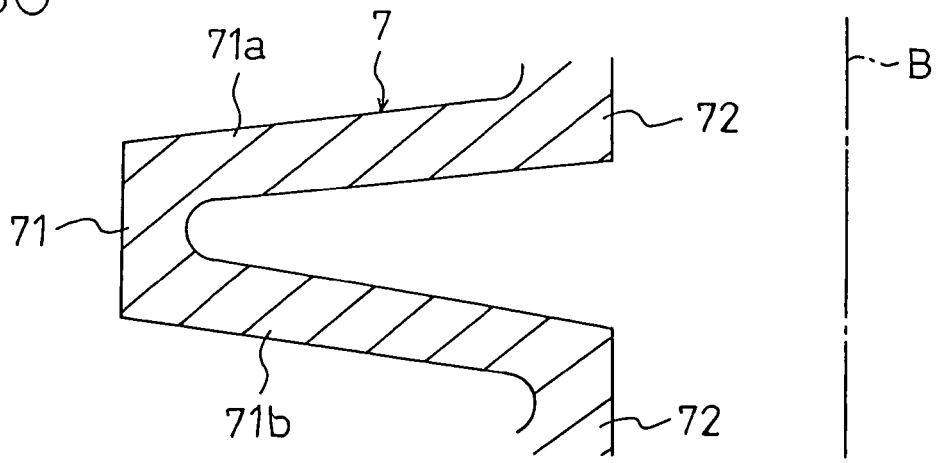
FIG. 5C is an enlarged section view showing a further modification of the extending and contracting portion of the bellows of the pump of the first embodiment.

In the thus configured pump, the invention is characterized in that the extending and contracting portion of the bellows 7 which is configured by forming ridge-like folds 71 and valley-like folds 72 in a vertically alternate and continuous manner is formed into a shape in which the lower one of upper and lower lamella portions 71*a* and 71*b* of each of the ridge-like folds 71, or the lower lamella portion 71*b* is downward inclined as moving toward the axis B, not only in an extending state but also in a contracting state as shown in FIGS. 5A, 5B, and 5C. In the contracting state of each of the ridge-like folds 71, the inclination angle $\alpha$ of the lower lamella portion 71*b*, i.e., the angle $\alpha$ formed by a horizontal line L perpendicular to the axis B is 1 to 45°, and more preferably 5 to 15°. However, the upper lamella portion 71*a* of each ridge-like fold 71 may be arbitrarily formed into one of the following shapes in the contracting state: a shape in which, as shown in FIG. 5A, the upper lamella portion is downward inclined at the same inclination angle as the lower lamella portion 71*b*; that in which, as shown in FIG. 5B, the upper lamella portion is horizontally formed in parallel with the horizontal line L perpendicular to the axis B; and that in which, as shown in FIG. 5C, the upper lamella portion is upward inclined as moving toward the axis B. In the illustrated examples, edges of the folded portion of each of the ridge-like folds 71 and the valley-like folds 72 are angled. Alternatively, the edges may be rounded (as indicated by the two-dot chain lines R).

According to this configuration, even in the case where liquid containing a sedimenting material such as slurry is used as the transported liquid, in the bellows 7, the sedimenting material easily slides down along the downward inclined face of the inner face of the lower lamella portion 71*b* of each ridge-like fold 71, and is prevented from stagnating and collecting on the inner face of the lamella portion 71*b*.

Figure 6:
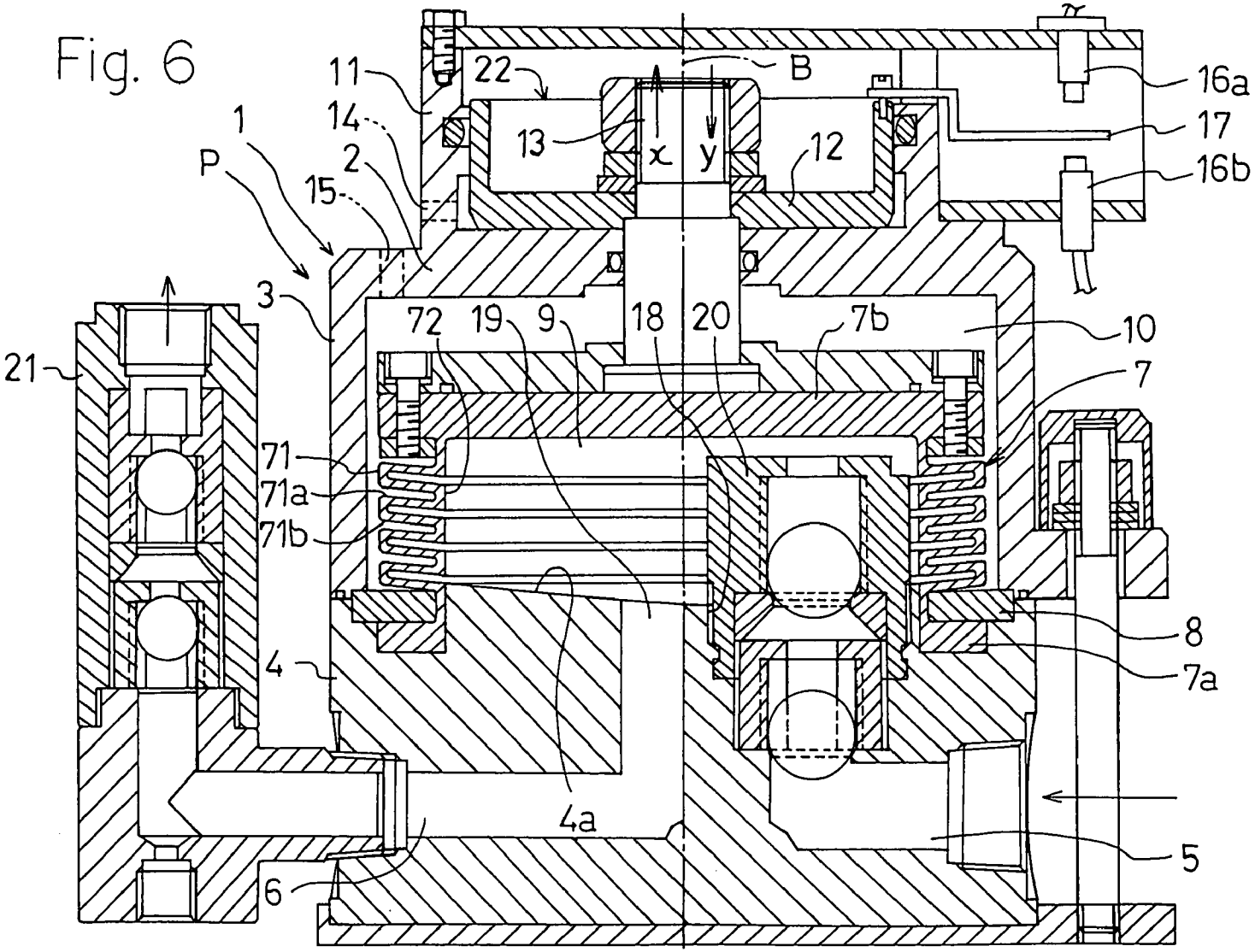
FIG. 6 is a longitudinal sectional front overall view showing another modification of the pump of the first embodiment.

Preferably, the inner bottom face 4*a* of the liquid chamber 9 is formed into a shape in which, as shown in FIG. 6, the face is downward inclined by 1 to 45°, and more preferably 5 to 150 as moving toward the discharge port 19, and the discharge port 19 is formed in the lowest position of the inner bottom face 4*a* which is preferably formed into a conical shape. However, it does not matter whether the discharge port 19 is on the axis B of the bellows 7 or in a position deviated from the axis B.

When the inner bottom face 4*a* of the liquid chamber 9 is formed into a shape in which the face is downward inclined as moving toward the discharge port 19, also liquid containing a sedimenting material such as slurry can be smoothly discharged along the downward inclined face of the inner bottom face 4*a* toward the discharge port 19, and the sedimenting material is prevented also from collecting and setting on the inner bottom face 4*a*. In cooperation with prevention of staying of sediment in the extending and contracting portion of the bellows 7, therefore, sedimenting and aggregation of sediment in the pump can be prevented more effectively from occurring.

Next, a second embodiment in which the fluid apparatus having a bellows of the invention is applied to an accumulator A will be described with reference to FIGS. 7 to 9.

Figure 7:
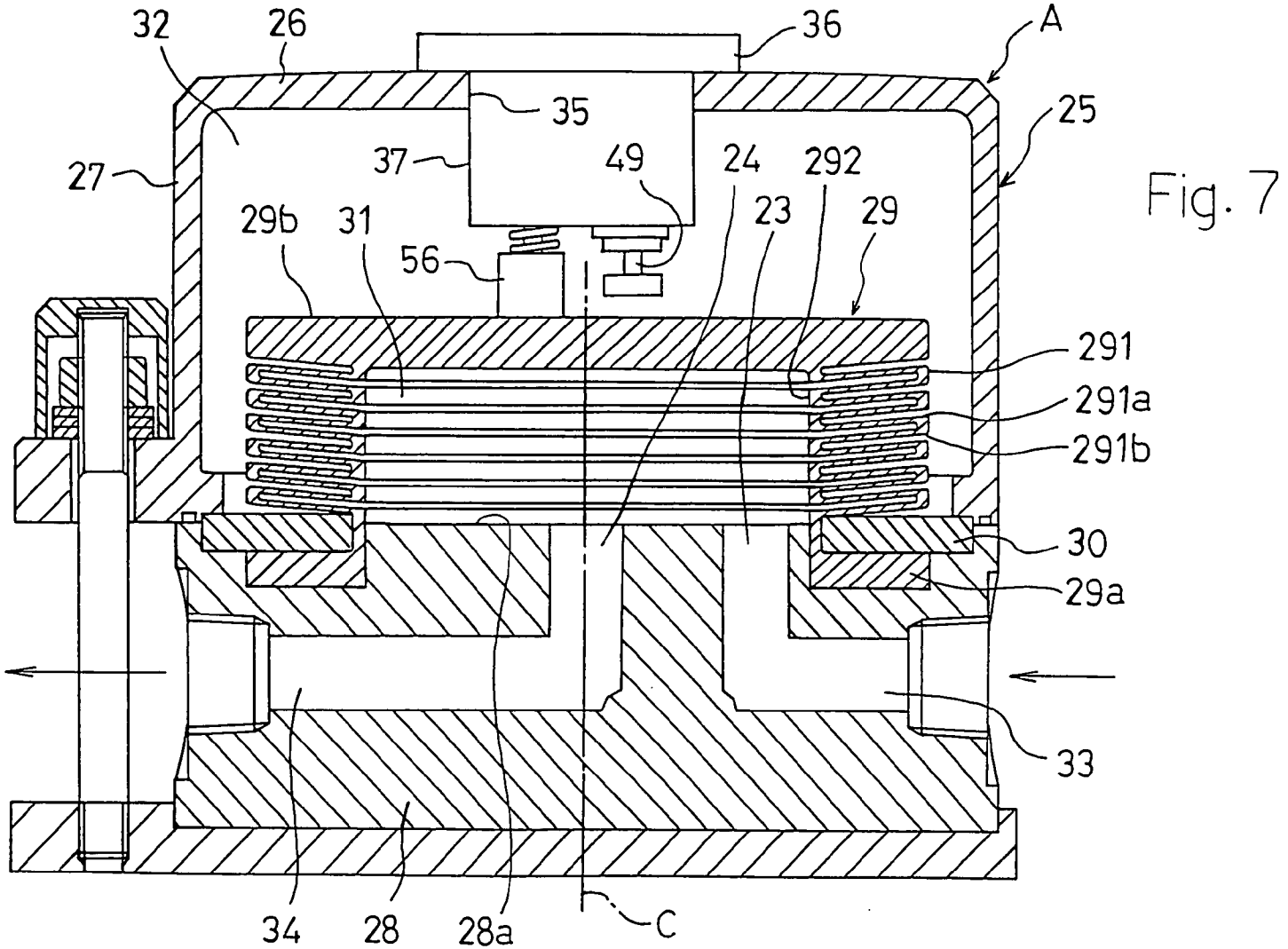
FIG. 7 is a longitudinal sectional front overall view of an accumulator of a second embodiment.

Referring to FIG. 7, 25 denotes the accumulator body having: a cylindrical casing 27 in which an upper end is closed by an upper wall 26; and a bottom wall 28 which airtightly closes an open lower end of the casing 27.

A bottomed cylindrical bellows 29 which is extendingly A and contractingly deformable in a direction of the axis C is placed in the casing 27 with setting the axis C vertical. The bellows 29 is molded by a fluororesin which has excellent heat and chemical resistances, such as PTFE or PFA. A lower opening peripheral edge 29*a* of the bellows is airtightly pressingly fixed to an upper side face of the bottom wall 28 by an annular fixing plate 30, whereby the inner space of the accumulator body 25 is partitioned into a liquid chamber 31 inside the bellows 29, and an air chamber 32 outside the bellows 29. A liquid inflow passage 33 and a liquid outflow passage 34 are formed in the bottom wall 28 of the accumulator body 25, and an inflow port 23 and an outflow port 24 are opened in the inner bottom face 28*a* of the bottom wall 28 which faces the liquid chamber 31 so as to communicate with the inflow passage 33 and the outflow passage 34, respectively.

For example, the accumulator A is used with being placed in a pipe line for a transported liquid in the pump P of the first embodiment in order to reduce pulsations of the pump P. In this case, the inflow passage 33 is connected to the downstream end side of the outflow passage 6 of the pump P so that the transported liquid discharged via the discharge check valve 21 of the pump P is temporarily stored in the liquid chamber 31, and the air chamber 32 is filled with air for reducing pulsations of the pump P. Therefore, the accumulator is configured so that pulsations caused by the discharge pressure of the transported liquid discharged from the liquid chamber 9 of the pump P is absorbed and damped by the capacity change of the liquid chamber 31 due to extending and contracting deformation of the bellows 29.

Figure 8:
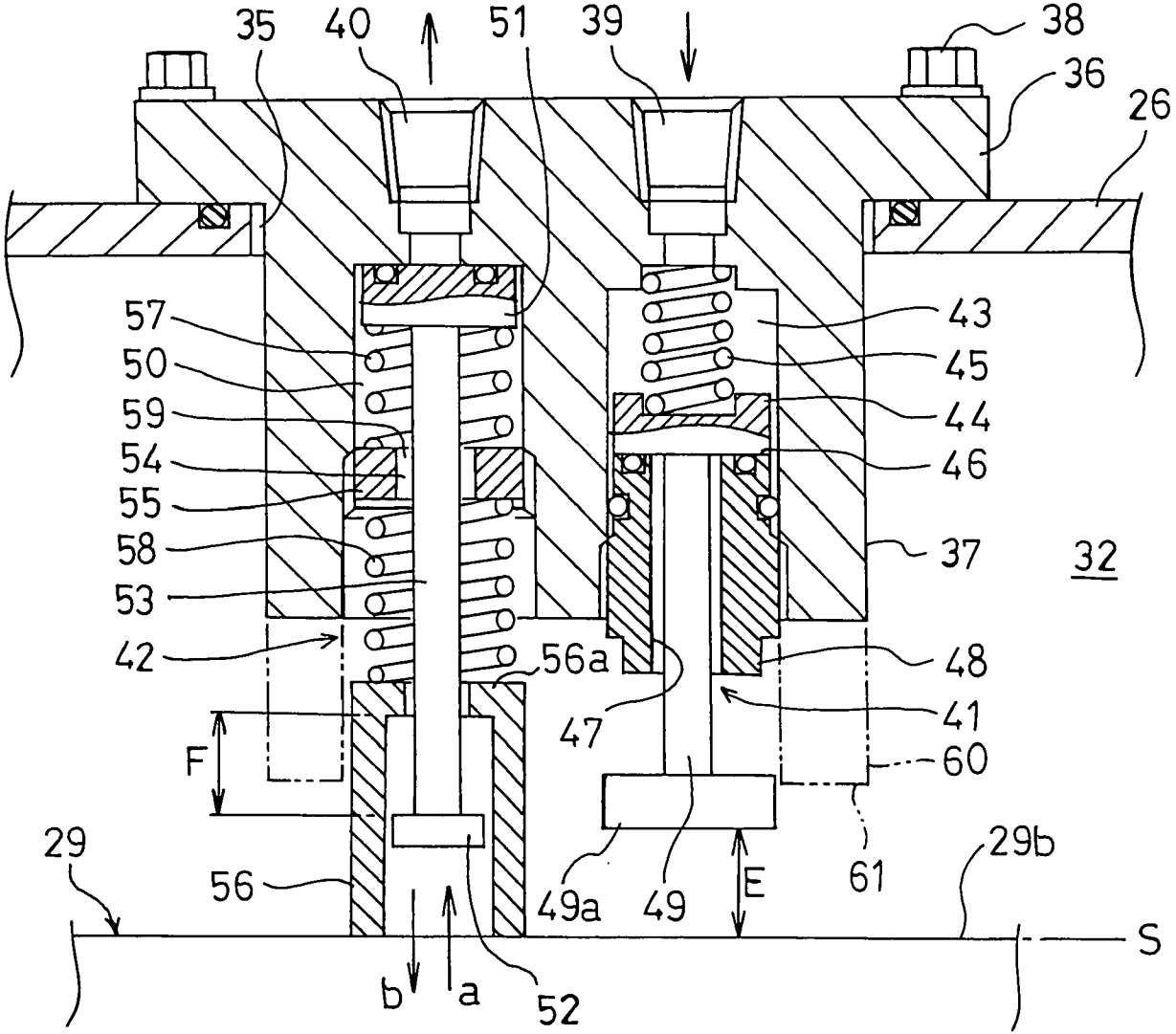
FIG. 8 is an enlarged longitudinal sectional front view of an automatic pressure adjusting mechanism of the accumulator of the second embodiment.

As shown in FIG. 8, an opening 35 for allowing air to inflow and outflow is formed in the vicinity of the center of the outer face of the upper wall 26 of the casing 27 of the accumulator A, a valve case 37 having a flange 36 is fitted into the opening 35, and the flange 36 is detachably fastened and fixed to the outside of the upper wall 26 by bolts 38 and the like.

An air supply port 39 and an air discharge port 40 are formed in the valve case 37 so as to be juxtaposed in parallel. An automatic air supply valve mechanism 41 is disposed in the air supply port 39. When the capacity of the liquid chamber 31 is increased to exceed a predetermined range, the air supply valve mechanism supplies air of a pressure which is equal to or higher than the maximum pressure of the transported liquid, into the air chamber 32, thereby raising the filling pressure in the air chamber 32. An automatic air discharge valve mechanism 42 is disposed in the air discharge port 40. When the capacity of the liquid chamber 31 is decreased to exceed the predetermined range, the air discharge valve mechanism discharges air from the air chamber 32 to lower the filling pressure in the air chamber 32.

The automatic air supply valve mechanism 41 comprises: an air supply valve chamber 43 which is formed in the valve case 37 so as to communicate with the air supply port 39; an air supply valve element 44 which is slidable in the valve chamber 43 along the axial direction of the chamber to open and close the air supply port 39; a spring 45 which always urges the valve element 44 to the closing position; a guide member 48 having, in an inner end portion, a valve seat 46 for the air supply valve element 44, and a through hole 47 through which the air supply valve chamber 43 and the air chamber 32 communicate with each other, the valve case being screwingly fixed to the valve case 37; and a valve operating rod 49 which is slidably passed through the through hole 47 of the guide member 48. Under the condition where the bellows 29 is in the reference position S in a mean pressure state of the liquid pressure in the liquid chamber 31, the air supply valve element 44 is in close contact with the valve seat 46 of the guide member 48 to close the air supply port 39, and an end portion 49*a* of the valve operating rod 49 which faces the air chamber 32 is separated from a closed upper end portion 29*b* of the bellows 29 by a stroke E.

By contrast, the automatic air discharge valve mechanism 42 comprises: an air discharge valve chamber 50 which is formed in the valve case 37 so as to communicate with the air discharge port 40; an air discharge valve element 51 which is slidable in the valve chamber 50 along the axial direction of the chamber to open and close the air discharge port 40; an air discharge valve rod 53 in which the valve element 51 is disposed at the tip end, and a flange 52 is disposed at the rear end; a spring receiver 55 screwingly fixed into the air discharge valve chamber 50, and having a through hole 54 through which the air discharge valve rod 53 is passed; a cylindrical slider 56 through which a rear end portion of the air discharge valve rod 53 is slidably passed, and which is prevented by the flange 52 from slipping off; a closing spring 57 which is disposed between the air discharge valve element 51 and the spring receiver 55; and an opening spring 58 which is disposed between the spring receiver 55 and the slider 56. The inner diameter of the through hole 54 of the spring receiver 55 is larger than the shaft diameter of the air discharge valve rod 53, so as to form a gap 59 between the two components. The air discharge valve chamber 50 and the air chamber 32 communicate with each other via the gap 59. Under the state where the bellows 29 is in the reference position S, the air discharge valve element 51 closes the air discharge port 40, and the flange 52 at the rear end of the air discharge valve rod 53 is separated from the inner face of a closing end portion 56*a* of the slider 56 by a stroke F.

As indicated by the phantom line 60 in FIG. 8, an end of the valve case 37 on the side of the air chamber is elongated in the direction of the interior of the air chamber 32, and a stopper 61 is disposed at the end of the elongated portion. When the bellows 29 is moved in the direction of extending the liquid chamber 31 in excess of the predetermined stroke E to operate the valve operating rod 49, the stopper restricts a further movement of the bellows 29.

Next, the operation of the thus configured accumulator will be described.

When the transported liquid is fed to a predetermined portion by the operation of the pump P, for example, the pump discharge pressure generates pulsations due to repetition of peak and valley portions.

The transported liquid discharged from the liquid chamber 9 of the pump P via the discharge check valve 21 is passed through the inflow passage 33 and the inflow port 23 of the accumulator and then sent into the liquid chamber 31. The liquid is temporarily stored in the liquid chamber 31, and thereafter discharged into the outflow passage 34 via the outflow port 24. When the discharge pressure of the transported liquid is in a peak portion of a discharge pressure curve, the transported liquid causes the bellows 29 to be extendingly deformed so as to increase the capacity of the liquid chamber 31, and hence the pressure of the liquid is absorbed. At this time, the flow quantity of the transported liquid flowing out from the liquid chamber 31 is smaller than that of the liquid supplied from the pump P.

By contrast, when the discharge pressure of the transported liquid comes to a valley portion of the discharge pressure curve, the pressure of the transported liquid becomes lower than the filling pressure of the air chamber 32 which is compressed by extending deformation of the bellows 29 of the accumulator, and hence the bellows 29 is contractingly deformed. At this time, the flow quantity of the transported liquid flowing our from the liquid chamber 31 is larger than that of the liquid flowing into the liquid chamber 31 from the pump P. This repeated operation, i.e., the capacity change of the liquid chamber 31 causes the pulsations to be absorbed and suppressed.

When the discharge pressure of the pump P is varied in the increasing direction during such an operation, the capacity of the liquid chamber 31 is increased by the transported liquid, with the result that the bellows 29 is largely extendingly deformed. When the amount of extending deformation of the bellows 29 exceeds the predetermined range E, the closed upper end portion 29*b* of the bellows 29 pushes the valve operating rod 49 toward the valve chamber. This causes the air supply valve element 44 of the automatic air supply valve mechanism 41 to be opened against the force of the spring 45, and air of the high pressure is supplied into the air chamber 32 through the air supply port 39, with the result that the filling pressure of the air chamber 32 is raised. Therefore, the amount of extending deformation of the bellows 29 is restricted so as not to exceed the stroke E, whereby the capacity of the liquid chamber 31 is suppressed from being excessively increased. When the stopper 61 is disposed at the end of the valve case 37 on the side of the air chamber, the closed upper end portion 29*b* of the bellows 29 abuts against the stopper 61, so that the bellows 29 can be surely prevented from being excessively extendingly deformed. This is advantageous to prevent the bellows from being damaged. In accordance with the rise of the filling pressure in the air chamber 32, the bellows 29 contracts toward the reference position S. Therefore, the valve operating rod 49 separates from the closed upper end portion 29*b* of the bellows 29, and the air supply valve element 44 returns to the closing position, so that the filling pressure in the air chamber 32 is fixed to an adjusted state.

By contrast, when the discharge pressure of the pump P is varied in the decreasing direction, the capacity of the liquid chamber 31 is decreased by the transported liquid, with the result that the bellows 29 is largely contractingly deformed. When the amount of contracting deformation of the bellows 29 exceeds the predetermined range F, the slider 56 of the automatic air discharge valve mechanism 42 is moved in the contraction direction b of the bellows 29 by the urging function of the opening spring 58, in accordance with the movement of the closed upper end portion 29*b* of the bellows 29 in the contraction direction b, and the inner face of the closing end portion 56*a* of the slider 56 is engaged with the flange 52 of the air discharge valve rod 53. This causes the air discharge valve rod 53 to be moved in the direction b and the air discharge valve element 51 opens the air discharge port 40. As a result, the filled air in the air chamber 32 is discharged into the atmosphere through the air discharge port 40, and the filling pressure of the air chamber 32 is lowered. Therefore, the amount of contracting deformation of the bellows 29 is restricted so as not to exceed the stroke F, whereby the capacity of the liquid chamber 31 is suppressed from being excessively decreased. In accordance with the reduction of the filling pressure in the air chamber 32, the bellows 29 extends toward the reference position S. Therefore, the slider 56 is pushed by the closed upper end portion 29*b* of the bellows 29, to compress the opening spring 58 while moving in the direction a. The air discharge valve element 51 again closes the air discharge port 40 by the urging function of the closing spring 57, whereby the filling pressure in the air chamber 32 is fixed to the adjusted state. As a result, pulsations are efficiently absorbed and the amplitude of pulsations is suppressed to a low level, irrespective of variation of the discharge pressure from the liquid chamber 9 of the pump P.

Figure 9A:
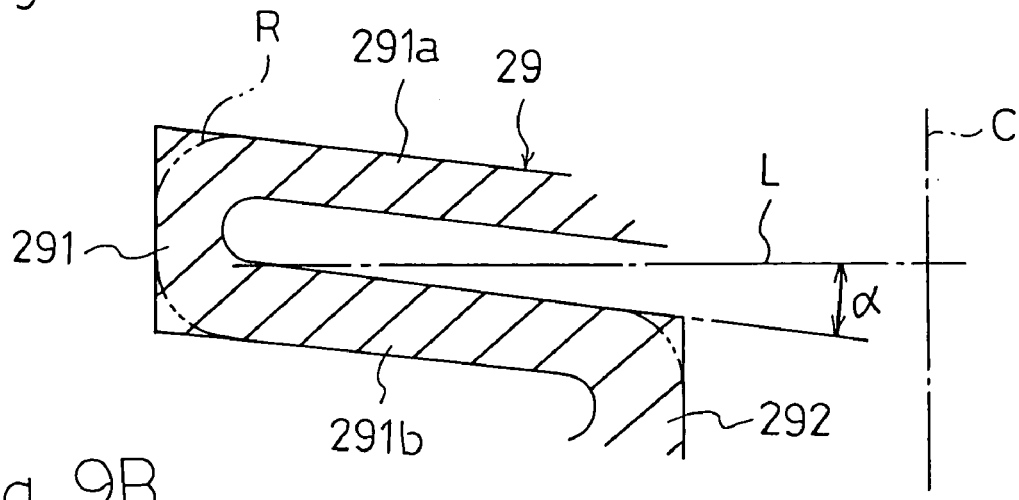
FIG. 9A is an enlarged section view of an extending and contracting portion of a bellows of the accumulator of the second embodiment.
Figure 9B:
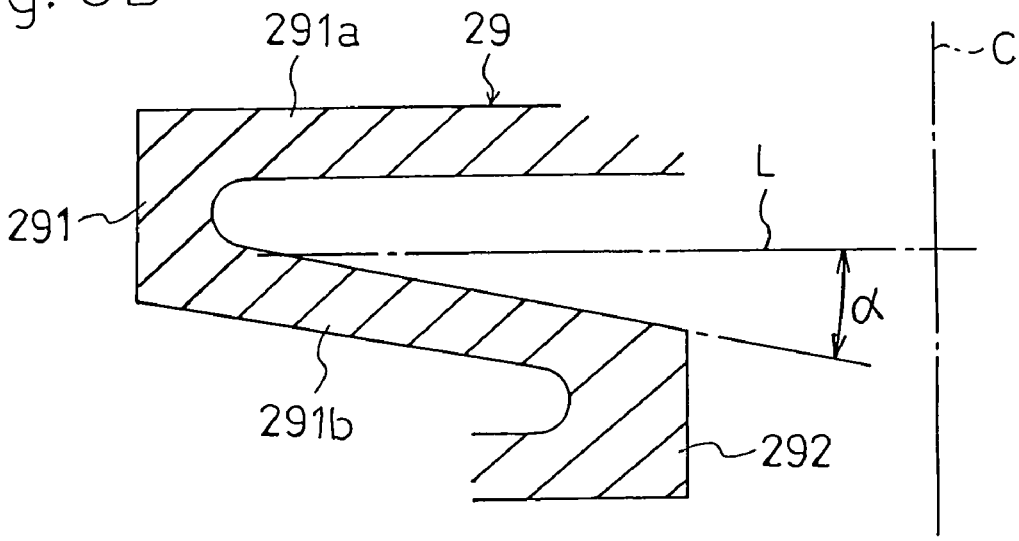
FIG. 9B is an enlarged section view showing another modification of the extending and contracting portion of the bellows of the accumulator of the second embodiment.
Figure 9C:
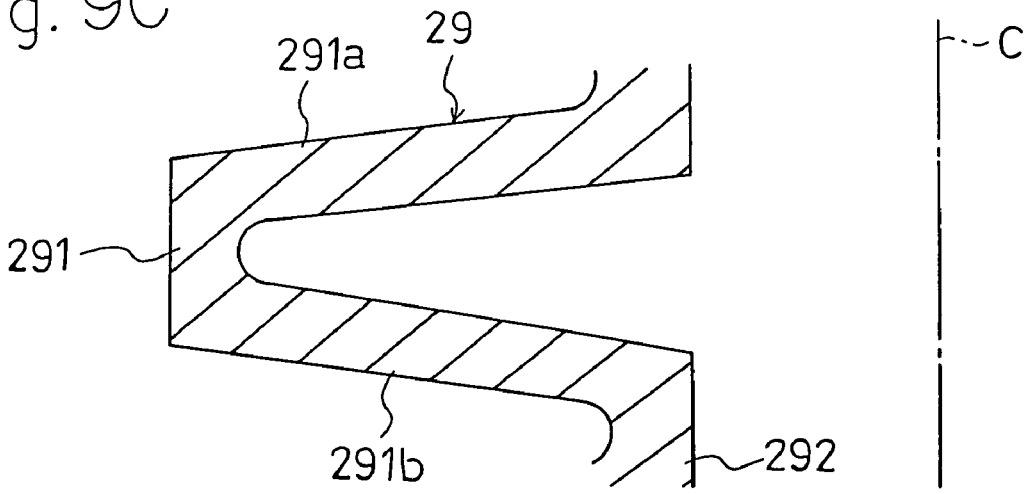
FIG. 9C is an enlarged section view showing a further modification of the extending and contracting portion of the bellows of the accumulator of the second embodiment.

In the thus configured accumulator A, in the same manner as the embodiment of the pump P described above, the invention is characterized in that the extending and contracting portion of the bellows 29 which is configured by forming ridge-like folds 291 and valley-like folds 292 in a vertically alternate and continuous manner is formed into a shape in which the lower one of upper and lower lamella portions 291*a* and 291*b* of each of the ridge-like folds 291, or the lower lamella portion 291*b* is downward inclined as moving toward the axis C, not only in an extending state, but also in a contracting state as shown in FIGS. 9A, 9B, and 9C. In the contracting state of the ridge-like folds 291, the inclination angle $\alpha$ of the lower lamella portion 291*b*, i.e., the angle $\alpha$ formed by a horizontal line L perpendicular to the axis C is 1 to 45°, and more preferably 5 to 15°. However, the upper lamella portion 291*a* of each ridge-like fold 291 may be arbitrarily formed into one of the following shapes in the contracting state: a shape in which, as shown in FIG. 9A, the upper lamella portion is downward inclined at the same inclination angle as the lower lamella portion 291*b*; that in which, as shown in FIG. 9B, the upper lamella portion is horizontally formed in parallel with the horizontal line L perpendicular to the axis C; and that in which, as shown in FIG. 9C, the upper lamella portion is upward inclined as moving toward the axis C. In the illustrated examples, edges of the folded portion of each of the ridge-like folds 291 and the valley-like folds 292 are angled. Alternatively, the edges may be rounded (as indicated by the two-dot chain lines R).

According to this configuration, even in the case where liquid containing a sedimenting material such as slurry is used as the transported liquid, in the bellows 29, the sedimenting material easily slides down along the downward inclined face of the inner face of the lower lamella portion 291*b* of each ridge-like fold 291, and is prevented from stagnating and collecting on the inner face of the lower lamella portion 291*b*.

Figure 10:
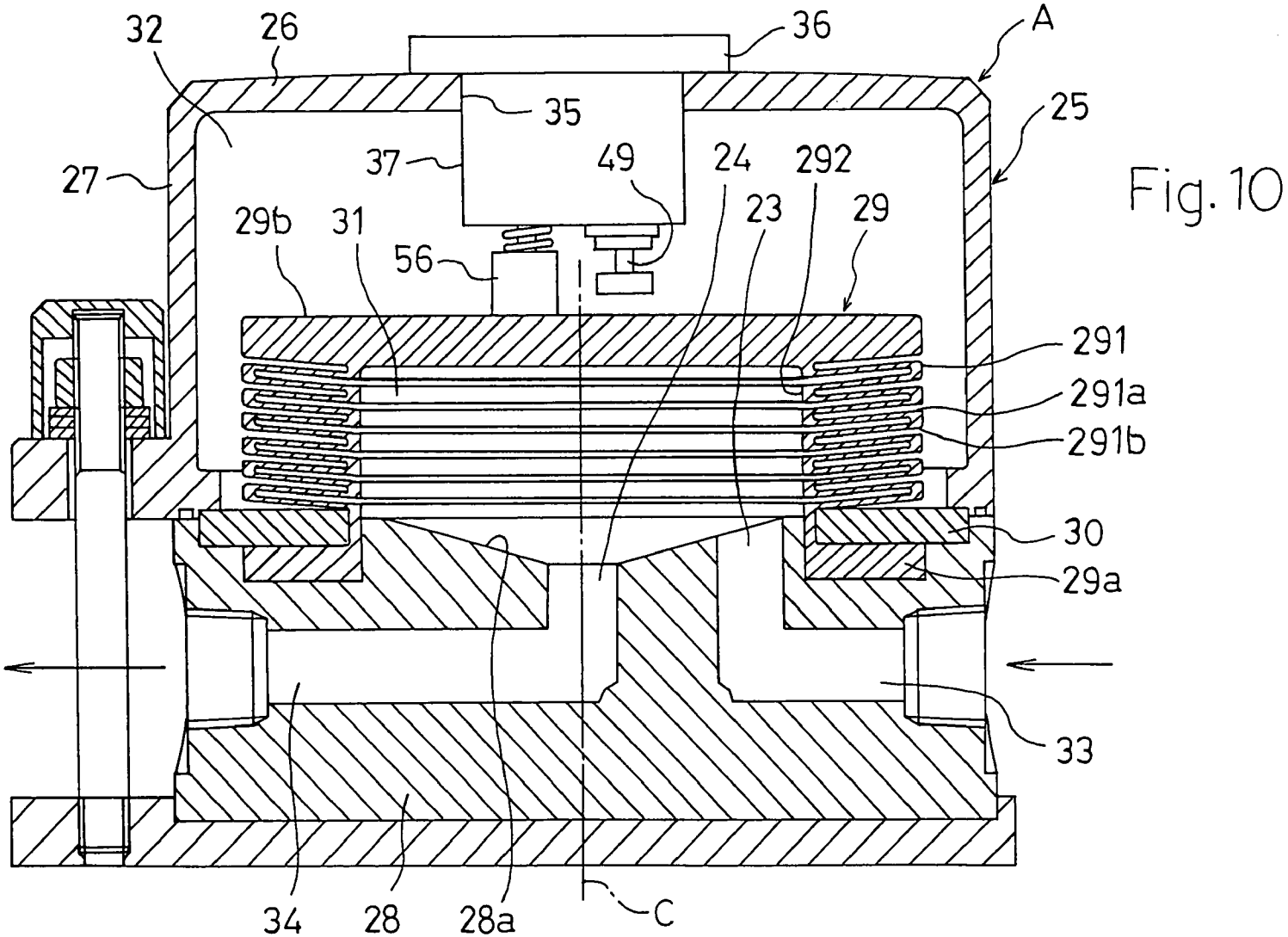
FIG. 10 is a longitudinal sectional front overall view showing another modification of the accumulator of the second embodiment.

Preferably, the inner bottom face 28*a* of the liquid chamber 31 is formed into a shape in which, as shown in FIG. 10, the face is downward inclined by 1 to 45°, and more preferably 5 to 15° as moving toward the outflow port 24, and the outflow port 24 is formed in the lowest position of the inner bottom face 28*a* which is preferably formed into a conical shape. However, it does not matter whether the outflow port 24 is on the axis C of the bellows 29 or in a position deviated from the axis C.

When the inner bottom face 28*a* of the liquid chamber 31 is formed into a shape which is downward inclined as moving toward the outflow port 24, also liquid containing a sedimenting material such as slurry can be smoothly discharged along the downward inclined face of the inner bottom face 28*a* toward the outflow port 24, and the sedimenting material is prevented also from collecting and setting on the inner bottom face 28*a*. In cooperation with prevention of staying of sediment in the extending and contracting portion of the bellows 29, therefore, sedimenting and aggregation of sediment in the accumulator can be prevented more effectively from occurring.

In the accumulator of the embodiment, an automatic pressure adjusting mechanism configured by an automatic air supply valve mechanism 41 and an automatic air discharge valve mechanism 42 is provided in the air chamber 32. A mechanism of the following configuration may be employed as the automatic pressure adjusting mechanism.

Figure 11:
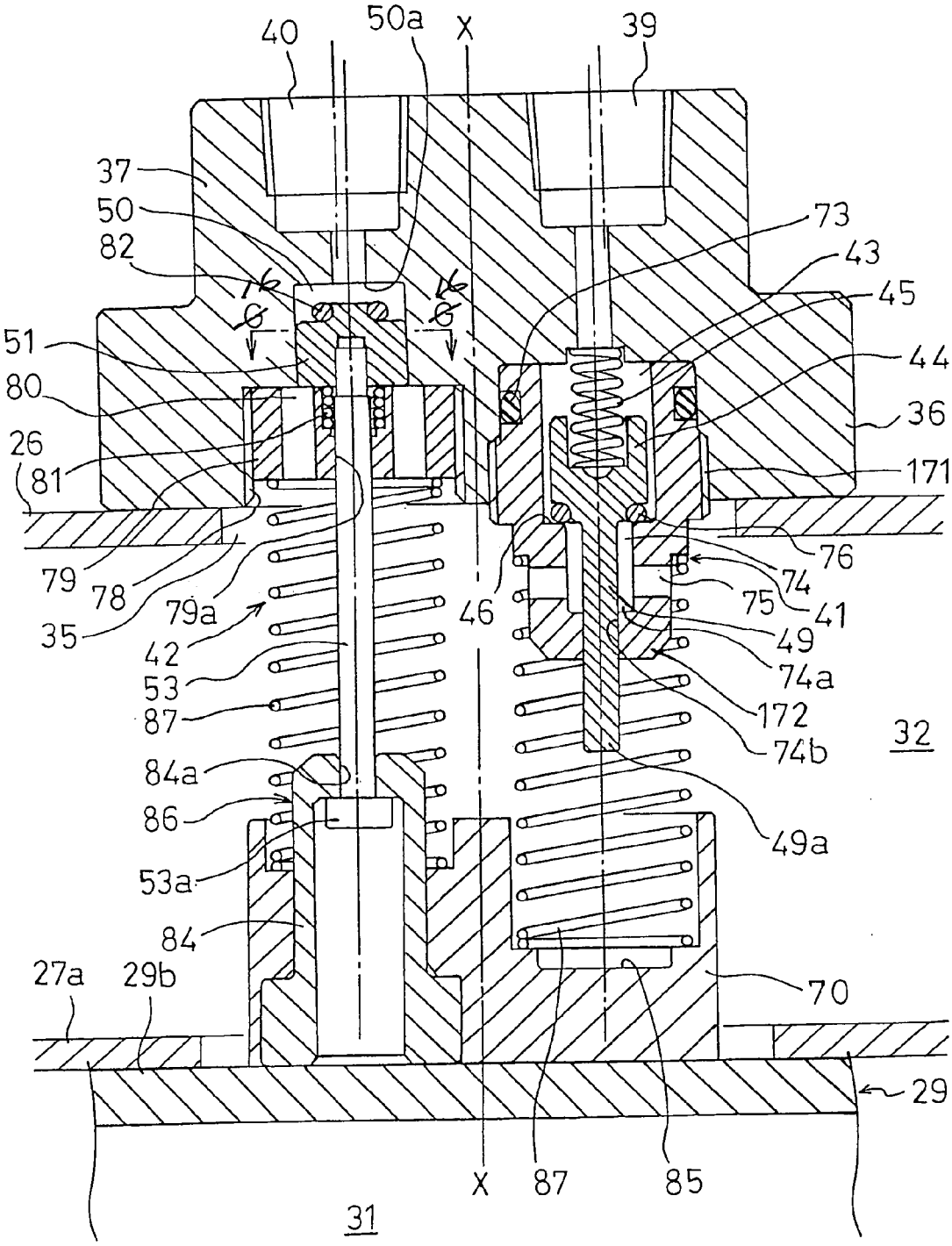
FIG. 11 is an enlarged longitudinal sectional front view showing another modification of the automatic pressure adjusting mechanism of the accumulator of the second embodiment.

Specifically, as shown in FIG. 11, in the automatic pressure adjusting mechanism, an opening 35 is formed in the vicinity of the center of the upper wall 26 of the casing 27 of the accumulator, a valve case 37 into which air supply and discharge valves are incorporated is fitted into the opening 35, and the flange 36 attached to the outer periphery of the rear end of the valve case 37 is detachably fastened and fixed to the upper wall 26 by bolts and the like. On the other hand, an air supply/discharge valve control plate 70 is abuttingly placed in a center area of the closed upper end portion 29*b* of the bellows 29 facing the air chamber 32, so as to be opposed to the valve case 37.

Figure 12:
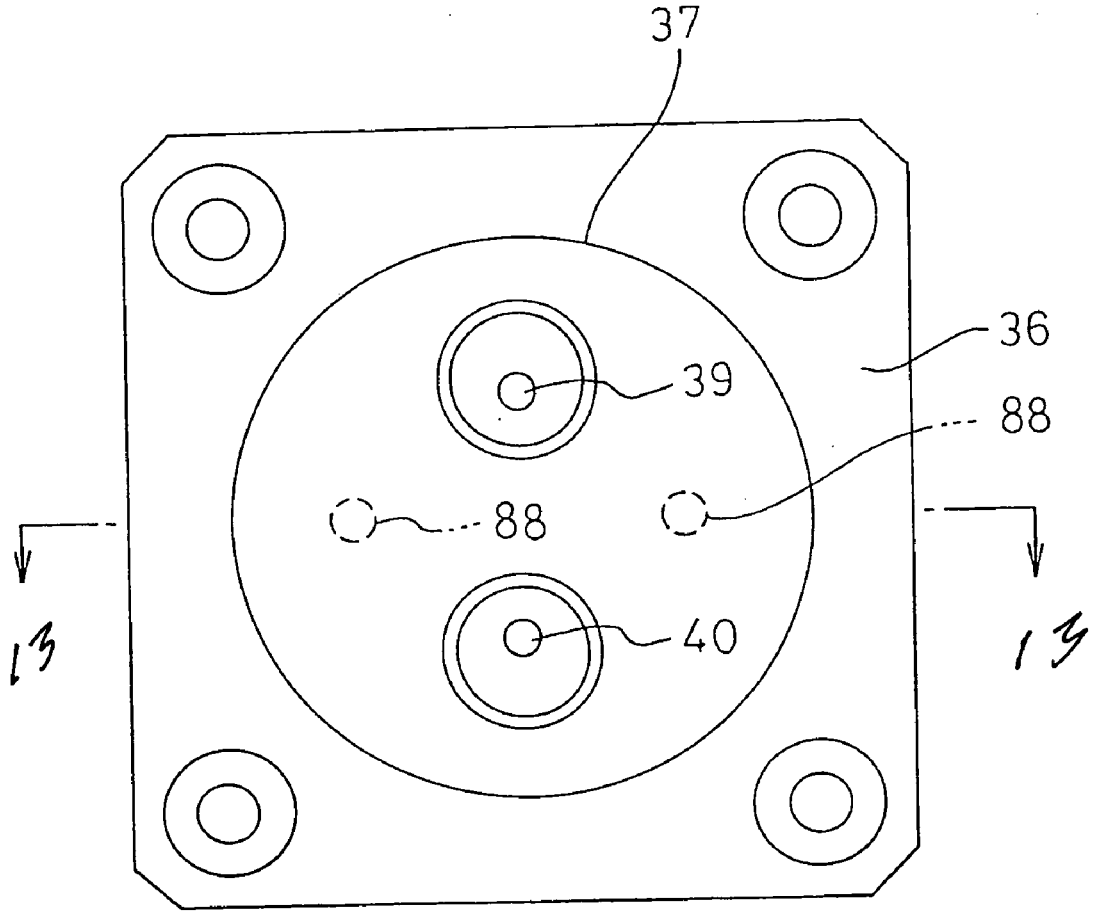
FIG. 12 is a plan view of the automatic pressure adjusting mechanism shown in FIG. 11.

As shown in FIG. 12, an air supply port 39 and an air discharge port 40 are juxtaposed in the front end face of the valve case 37. The automatic air supply valve mechanism 41 is disposed in the air supply port 39. When the capacity of the liquid chamber 31 is increased to exceed a predetermined range, the automatic air supply valve mechanism supplies air of a pressure which is higher than the maximum pressure of the transported liquid, into the air chamber 32, thereby raising the filling pressure in the air chamber 32. The automatic air discharge valve mechanism 42 is disposed in the air discharge port 40. When the capacity of the liquid chamber 31 is reduced to exceed the predetermined range, the automatic air discharge valve mechanism discharges air from the air chamber 32, thereby lowering the filling pressure in the air chamber 32.

In the automatic air supply valve mechanism 41, as shown in FIG. 11, an internal thread portion 171 is formed in the rear end face of the valve case 37 so as to communicate with the air supply port 39, and an air supply valve holder 172 which holds an air supply valve element 44 and a valve rod 49 that is integral with the valve element is screwingly fixed to the internal thread portion 171 via an O-ring 73. In the air supply valve holder 172, an air supply valve chamber 43 is formed in a front side end portion which is screwed into the internal thread portion 171, a valve seat 46 is formed in the inner bottom of the air supply valve chamber 43, and a valve rod passing hole 74 is formed in the rear end portion so as to coaxially communicate with the air supply valve chamber 43. A plurality of communication holes 75 through which the air supply valve chamber 43 communicates with the air chamber 32 via the valve rod passing hole 74 are formed in the outer periphery of the rear end portion of the air supply valve holder 172. The formation of the communication holes 75 improves the responsibility to a pressure change in the air chamber 32.

In the air supply valve holder 172, an air supply valve 36 is incorporated into the air supply valve chamber 43 so as to be movable in the axial direction, and the valve rod 49 is passed through the valve rod passing hole 74. A rear end portion of the valve rod 49 protrudes into the rear of the air supply valve holder 172. The valve rod passing hole 74 is formed into a stepped shape having: a larger diameter hole portion 74*a* in which the inner diameter is larger than the outer diameter of the valve rod 49 to form a communication gap between the hole portion and the valve rod 49; and a guide hole portion 74*b* which is slightly larger than the outer diameter of the valve rod 49 and slidingly contacted with the valve rod 49 without leaving a substantial gap therebetween. When the valve rod 49 of the air valve element 44 is slidingly guided by the guide hole portion 74*b*, the air valve element 44 can be straightly moved in the air supply valve chamber 43 along the axial direction of the chamber.

Figure 14:
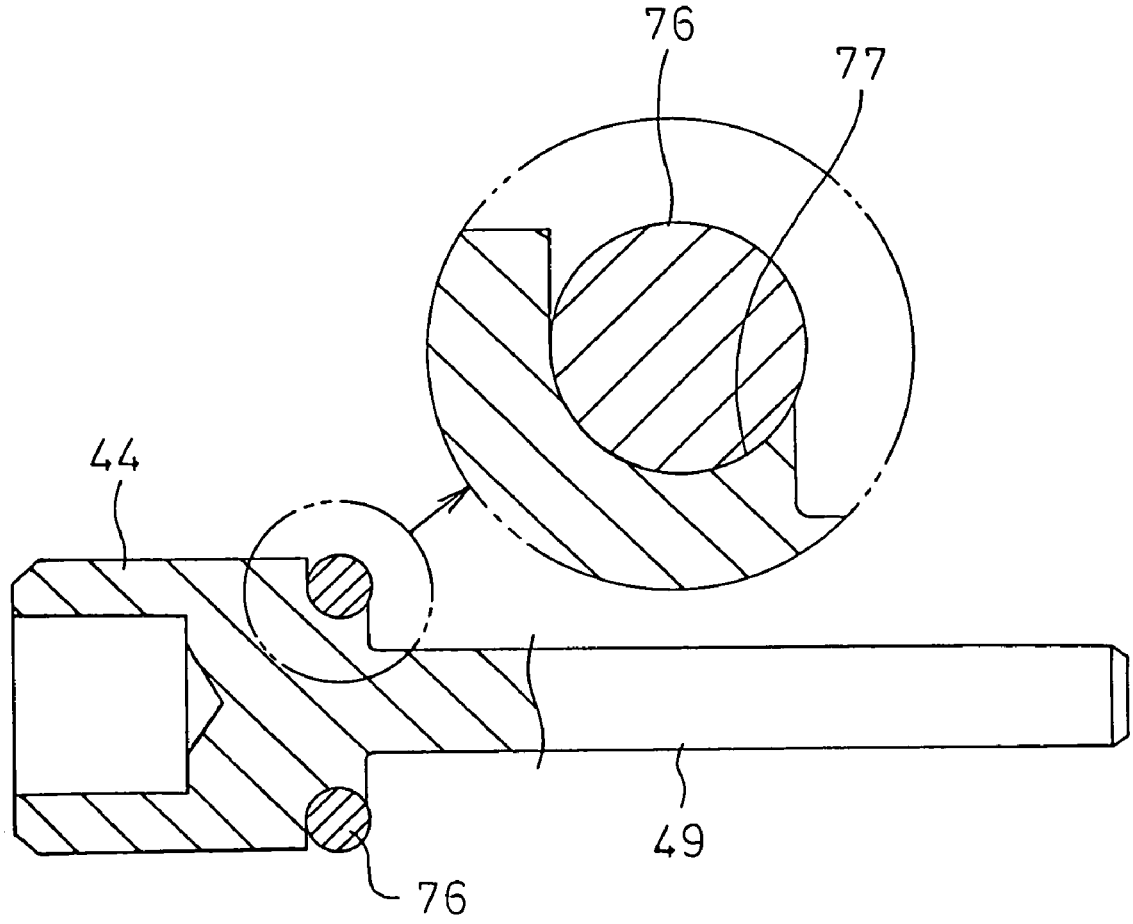
FIG. 14 is a section view of an air supply valve of the automatic pressure adjusting mechanism shown in FIG. 11.

In the air supply valve chamber 43, the air supply valve element 44 is always urged by a spring 45 so as to be in the closing position where the element is closely contacted with the valve seat 46. The air supply valve element 44 is airtightly contacted with the valve seat 46 via an O-ring 76. As shown in FIG. 14, the O-ring 76 is fitted into an arcuate groove 77 formed in a corner portion of the rear end face of the air supply valve element 44, whereby the O-ring is lockedly attached to the valve element.

In a state where the liquid pressure in the liquid chamber 31 is at an average pressure and the bellows 29 is in the reference position, the air supply valve element 44 is closely contacted with the valve seat 46 of the valve rod holder 172 to close the air supply port 39, and an end portion 49*a* of the valve rod 49 facing the interior of the air chamber 32 is separated from the closed upper end portion 29*b* of the bellows 29 by a predetermined stroke.

Figure 15:
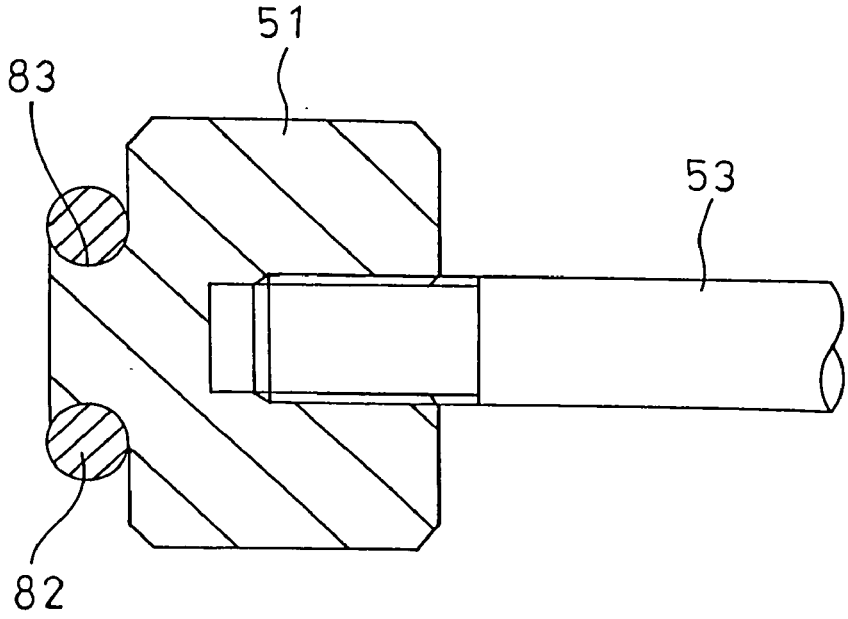
FIG. 15 is a section view of an air discharge valve of the automatic pressure adjusting mechanism shown in FIG. 11.
Figure 16:
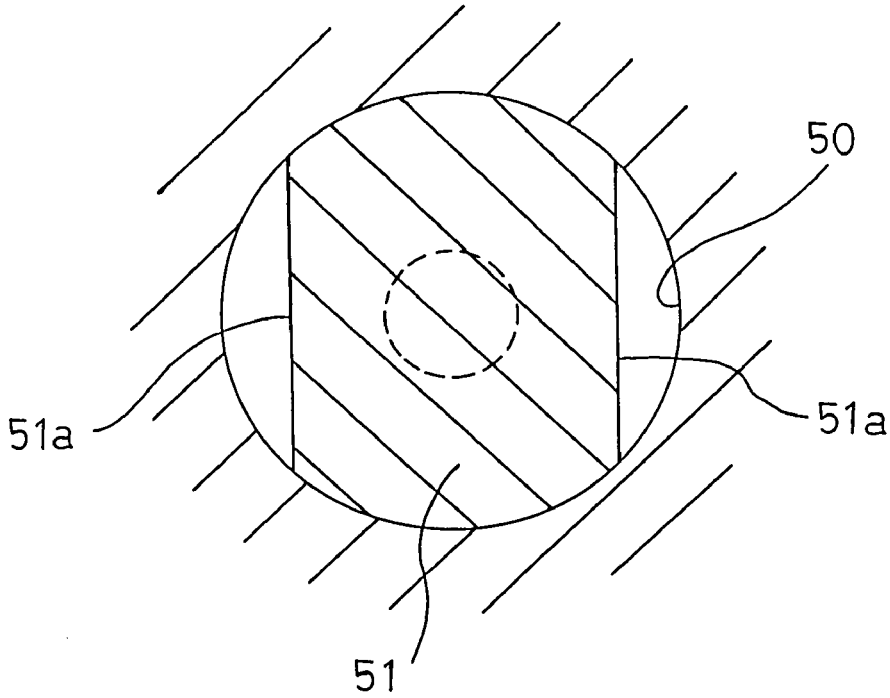
FIG. 16 is a section view taken along the line 16—16 of FIG. 11.

On the other hand, in the automatic air discharge valve mechanism 42, as shown in FIG. 11, an air discharge valve chamber 50 having a circular section shape, and an internal thread portion 78 having an inner diameter which is larger than that of the air discharge valve chamber 50 are formed in the rear end face of the valve case 37 so as to coaxially communicate with the air discharge port 40. The air discharge valve element 51 having a shape in which flat faces 51*a* are formed in opposing portions on the circumference as shown in FIG. 16 is incorporated in the air discharge valve chamber 50 so as to be movable along the axial direction. The air discharge valve rod 53 is integrally coupled to the air discharge valve element 51. The air discharge valve rod 53 is passed through and held by a valve rod guide hole portion 79*a* so as to be slidable in the axial direction. The valve rod guide hole portion 79*a* is in the center of a discharge valve rod holder 79 which is screwingly fixed to the internal thread portion 78. In the air discharge valve rod holder 79, a plurality of communication holes 80 through which the air discharge valve chamber 50 communicates with the air chamber 32 are formed on the same circle that is centered at the valve rod guide hole portion 79*a*. A spring 81 through which the air discharge valve rod 53 is passed is interposed between the air discharge valve element 51 and the air discharge valve rod holder 79. The air discharge valve element 51 is always urged by the spring 81 so as to be in the closing position where the element is closely contacted with the valve seat 50*a* of the air discharge valve chamber 50. The air discharge valve element 51 is airtightly contacted with the valve seat 50*a* via an O-ring 82. As shown in FIG. 15, the O-ring 82 is fitted into an arcuate groove 83 formed in a corner portion of the front end face of the air discharge valve element 51, whereby the O-ring is lockedly attached to the vale element.

In a state where the bellows 29 is in the reference position, the air discharge valve element 51 closes the air discharge port 40, and a flange 53*a* in the rear end of the air discharge valve rod 53 is separated from the inner face of a closed end portion 84*a* of a sleeve 84 by a predetermined stroke.

On the other hand, the air supply/discharge valve control plate 70 which is abuttingly placed in the center area of the closed upper end portion 29*b* of the bellows 29 is formed into a disk-like shape, an air supply valve rod pressing portion 85 is recessed in the front face of the plate, and the sleeve 84 constituting an air discharge valve rod pulling portion 86 is fittingly fixed in juxtaposition with the air supply valve rod pressing portion 85. A guide hole portion 84*a* which is slightly larger than the outer diameter of the air discharge valve rod 53 and slidingly contacted with the valve rod 53 without leaving a substantial gap therebetween is formed in a front end portion of the sleeve 84. The rear end portion of the air discharge valve rod 53 having the flange 53*a* is passed through and coupled to the guide hole portion 84*a* in a slidable and slipping-off preventing manner. When the air discharge valve rod 53 is slidingly guided by the guide hole portion 84*a*, the air discharge valve rod 53 can be straightly moved along the axial direction. The sleeve 84 may be formed integrally with the air supply/discharge valve control plate 70.

Springs 87 each consisting of a compression coil spring are interposed between the air supply valve rod pressing portion 85 of the air supply/discharge valve control plate 70 and the rear end portion of the air supply valve holder 172, and the sleeve 84 and the rear end face of the air discharge valve rod holder 79, so as to surround the outer peripheries of the air supply valve rod 49 and the air discharge valve rod 53, respectively. The air supply/discharge valve control plate 70 is urged by the springs 87 and 87 to be pressed toward the center area of the closed upper end portion 29*b* of the bellows 29.

Figure 13:
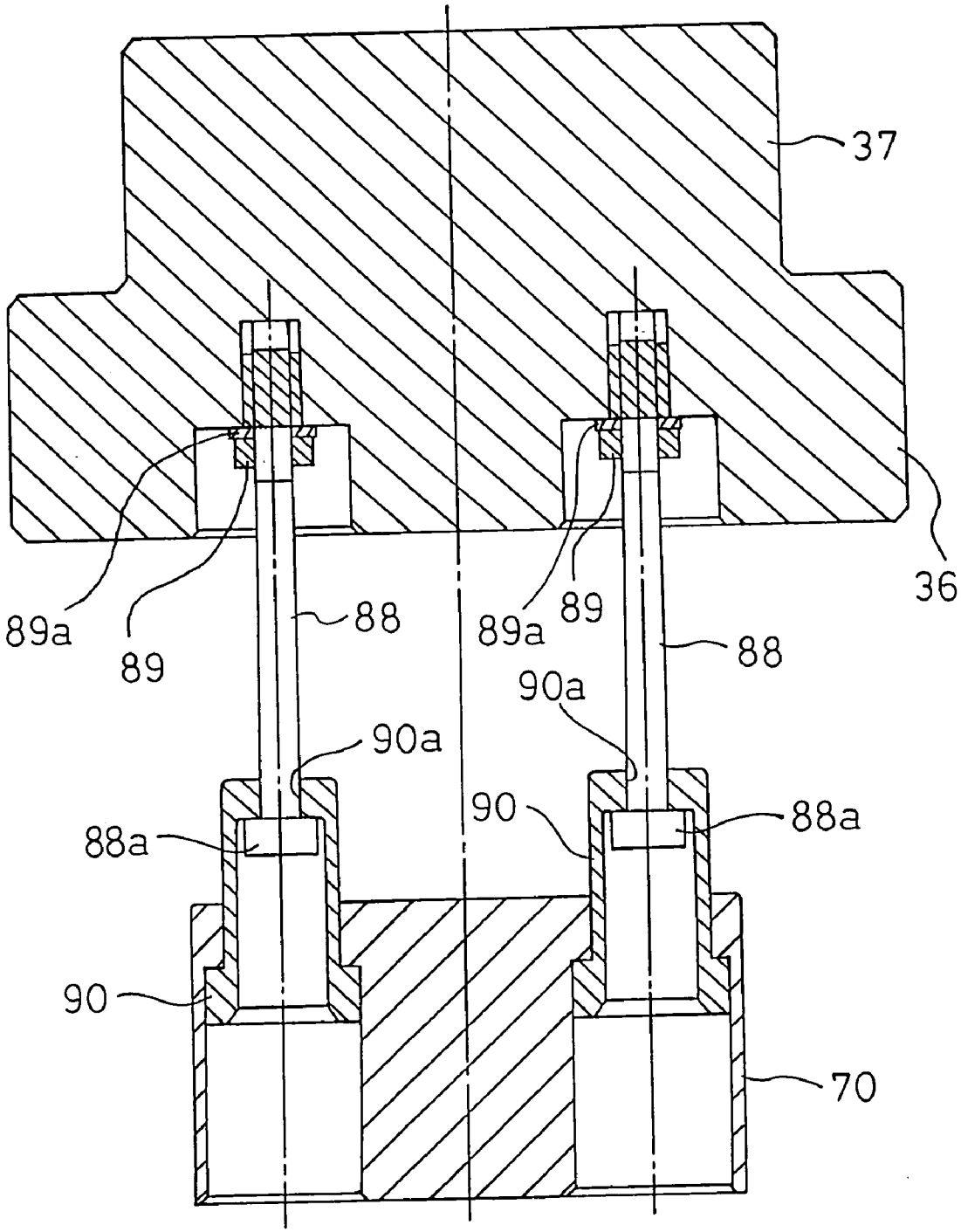
FIG. 13 is a section view taken along the line 13—13 of FIG. 12.

As shown in FIG. 13, the air supply/discharge valve control plate 70 and the valve case 37 are coupled to each other by one, or preferably plural guide shafts 88 which are parallel to the extending and contracting directions of the bellows 29. In each of the guide shafts 88, the front end portion is fasteningly fixed to the rear end face of the valve case 37 by a nut 89 via a washer 89*a*, and the rear end portion having a flange 88*a* is coupled to a guide sleeve 90 which is embeddedly fixed to the front end face of the air supply/discharge valve control plate 70, so as to be prevented from slipping off, and slidable in the axial direction. In the front end portion of each of the guide sleeves 90, a guide hole portion 90*a* which is slidingly contacted with the corresponding guide shaft 88 without leaving a substantial gap therebetween is formed. The rear end portions of the guide shafts 88 are passed through the guide hole portions 90*a*, thereby enabling the air supply/discharge valve control plate 70 to be straightly moved in parallel with the extending and contracting directions of the bellows 29 under guidance of the guide shafts 88. The guide sleeves 90 may be formed integrally with the air supply/discharge valve control plate 70.

Next, the operation of the thus configured automatic air supply/discharge valve mechanisms 41 and 42 will be described.

Figure 17A:
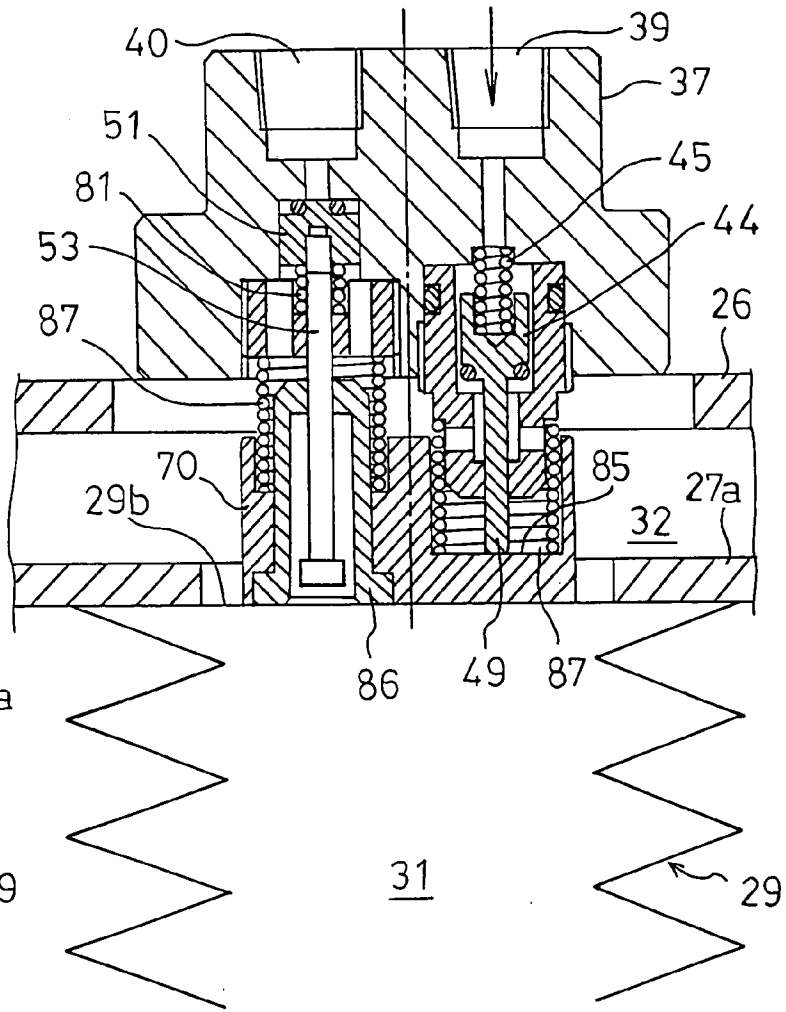
FIG. 17A is an operation diagram of the air supply valve and the air discharge valve of the automatic pressure adjusting mechanism in the case where the fluid pressure in the bellows of the accumulator is raised.
Figure 17B:
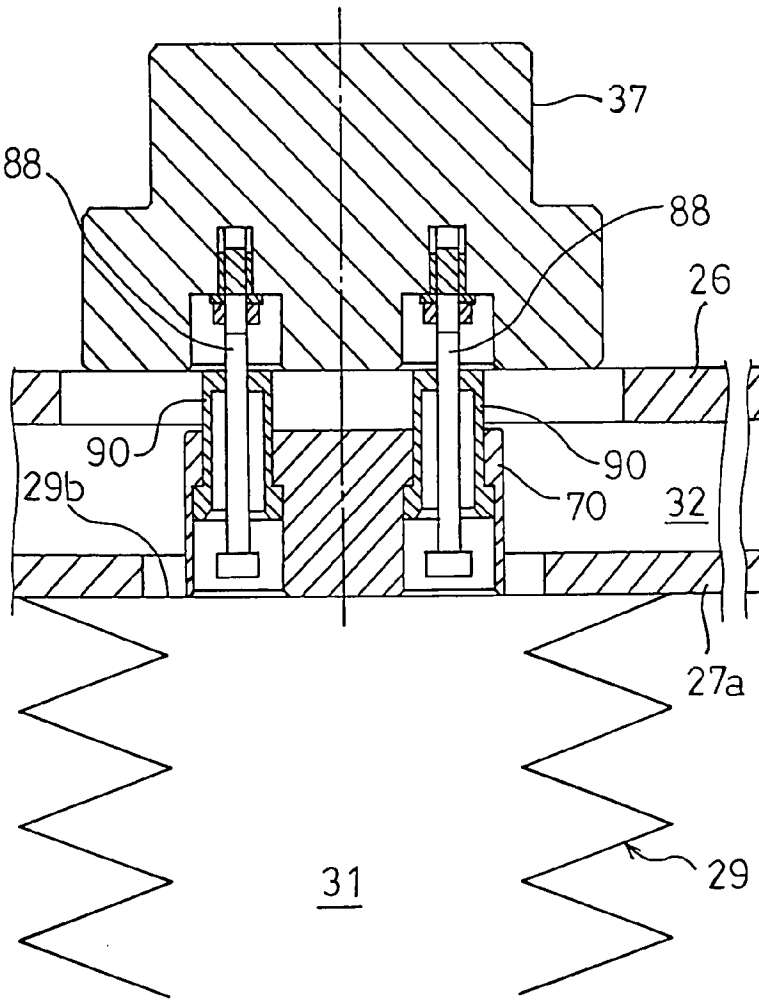
FIG. 17B is an operation diagram of a guide shaft and a guide sleeve of the automatic pressure adjusting mechanism in the case where the fluid pressure in the bellows of the accumulator is raised.

When the discharge pressure of the reciprocating pump P is varied in the increasing direction, the capacity of the liquid chamber 31 is increased by the transported liquid, and the fluid pressure in the liquid chamber 31 overcomes the pressure in the air chamber 32, so that the bellows 29 is extendingly deformed. As shown in FIGS. 17A and 17B, this extending deformation of the bellows 29 causes the air supply/discharge valve control plate 70 to be pushed by the center area of the closed upper end portion 29*b* of the bellows 29 toward the valve case 37. As a result, the rear end portion of the air supply valve rod 49 is pushed by the air supply valve rod pressing portion 85 of the air supply/discharge valve control plate 70, whereby the air supply valve element 44 which has been set to the closing state by the spring 45 is changed to the opening state. Therefore, the compressed air is supplied into the air chamber 32 through the air supply port 39 to raise the filling pressure in the air chamber 32. In accordance with the rise of the filling pressure in the air chamber 32, the bellows 29 is contracted. Then, the air supply valve rod pressing portion 85 of the air supply/discharge valve control plate 70 does not push the rear end portion of the air supply valve rod 49, and the air supply valve element 44 is set to the closing state by the spring 45 and the compressed air in the air chamber 32, so as to balance with the fluid pressure in the liquid chamber 31. When the bellows 29 is extended by a degree which is greater than the predetermined stroke, the closed upper end portion 29*b* of the bellows strikes against a stopper wall 27*a* of the casing 27 of the accumulator A which protrudes into the air chamber 32, whereby excessive extending deformation of the bellows 29 is restricted, so that the bellows can be prevented from being damaged.

Figure 18A:
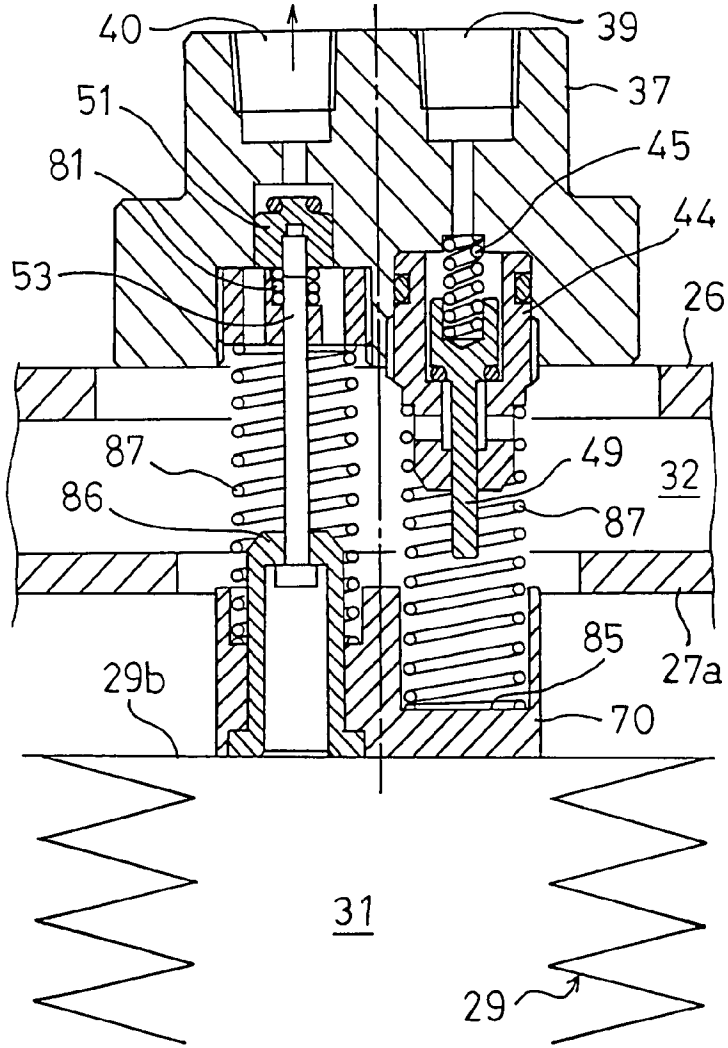
FIG. 18A is an operation diagram of the air supply valve and the air discharge valve of the automatic pressure adjusting mechanism in the case where the fluid pressure in the bellows of the accumulator is lowered.
Figure 18B:
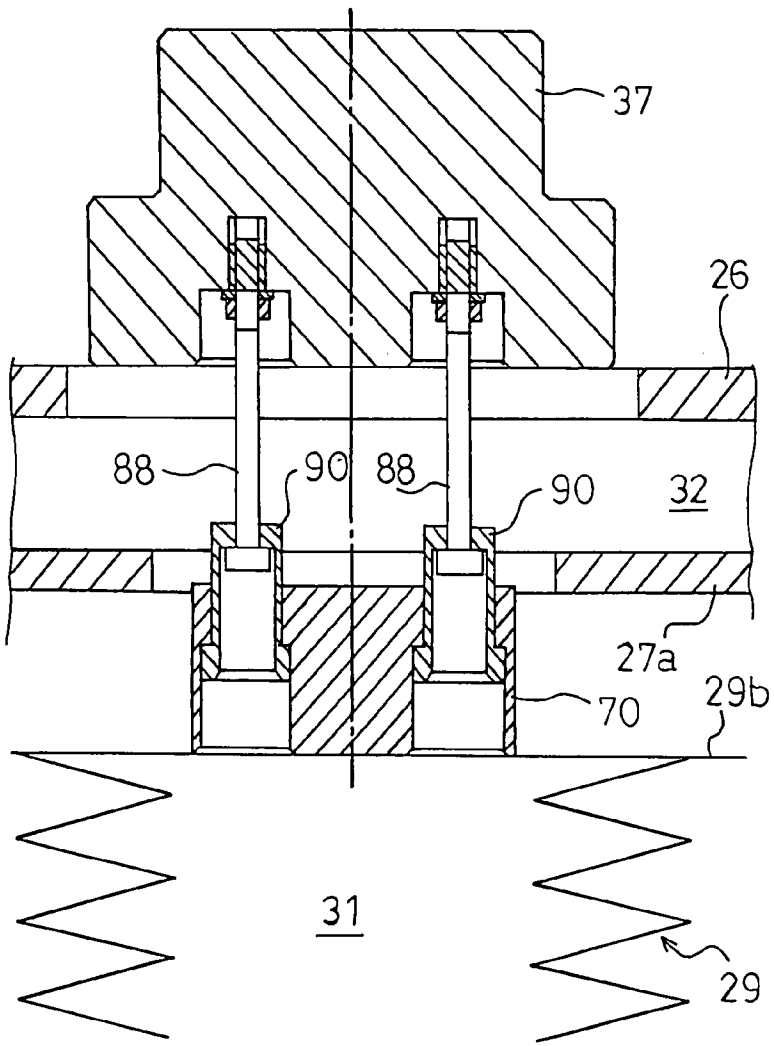
FIG. 18B is an operation diagram of the guide shaft and the guide sleeve of the automatic pressure adjusting mechanism in the case where the fluid pressure in the bellows of the accumulator is lowered.

By contrast, when the discharge pressure of the reciprocating pump P is varied in the decreasing direction, the capacity of the liquid chamber 31 is reduced by the transported liquid, and the pressure in the air chamber 32 overcomes the fluid pressure in the liquid chamber 31, so that the bellows 29 is contractingly deformed. As shown in FIGS. 18A and 18B, this contracting deformation of the bellows 29 causes the air supply/discharge valve control plate 70 to, in accordance with the movement of the closed upper end portion 29*b* of the bellows 29 in the contracting direction, be moved in the same direction while receiving the urging force of the springs 87. The air discharge valve rod 53 which is coupled to the discharge valve rod pulling portion 86 of the air supply/discharge valve control plate 70 is pulled in the same direction, whereby the air discharge valve element 51 is changed to the opening state. Therefore, the compressed air in the air chamber 32 is discharged to the atmosphere from the air discharge port 40 to lower the filling pressure in the air chamber 32. In accordance with the reduction of the filling pressure in the air chamber 32, the bellows 29 is extended. Then, the air supply/discharge valve control plate 70 is pushed by the center area of the closed upper end portion 29*b* of the bellows 29, and the air discharge valve element 51 is caused to close the air discharge port 40 by the urging action of the spring 81. As a result, the filling pressure in the air chamber 32 is fixed to the adjusted state.

As described above, when a fluid pressure is applied into the bellows 29, the compressed air is sucked or discharged until balance with the pressure is attained, whereby pulsations are efficiently absorbed and the amplitude of pulsations is suppressed to a low level, irrespective of variation of the discharge pressure of the reciprocating pump P.

In this way, the air supply valve element 44 and the air discharge valve element 51 which are separately and independently disposed in the valve case 37 are subjected to the valve-opening control in accordance with expansion and contraction of the bellows 29, via the air supply valve rod pressing portion 85 and the air discharge valve rod pulling portion 86 on the air supply/discharge valve control plate 70. Since the air supply/discharge valve control plate 70 is placed so as to always abut against the center area of the closed upper end portion 29*b* of the bellows 29, no offset load is applied to the bellows 29 even when the air supply valve element 44 and the air discharge valve element 51 are juxtaposed separately and independently in the valve case 37. Therefore, the bellows 29 is always straightly extendingly and contractingly deformed in the axial direction X—X of the valve case 37, whereby the responsibility of the opening and closing operations of the air supply and discharge valve elements 44 and 51 can be improved and the performance of reducing pulsations can be ensured. The air supply/discharge valve control plate 70 can be always enabled to be moved in parallel stably and surely by the guiding action of the guide shafts 88. Consequently, the air supply and discharge valve elements 44 and 51 can faithfully perform the opening and closing operations corresponding to expansion and contraction of the bellows 29, via the air supply/discharge valve control plate 70.

In the accumulator of the above-described embodiment, the automatic pressure adjusting mechanism consisting of the automatic air supply valve mechanism 41 and the automatic air discharge valve mechanism 42 is attached to the air chamber 32. The air chamber 32 is required only to have the opening 35 for allowing air to inflow and outflow, and is not always requested to have the automatic pressure adjusting mechanism. The pressure adjustment may be manually performed.

INDUSTRIAL APPLICABILITY

According to the invention, even in the case where liquid containing a sedimenting material such as slurry is used, the sedimenting material can be effectively prevented from sedimenting and aggregating in a pump or an accumulator.

What is claimed is:

1. A fluid apparatus for a semiconductor producing apparatus having a bellows configured as a pump and placed in a pump body, said bellows made of polytetrafluoroethylene including extending and contracting portions configured by forming ridge-like folds and valley-like folds in a vertically alternate and continuous manner, which are extendingly and contractingly deformable in an axial direction said axial direction defining a vertical axis, said ridge-like folds and said valley-like folds having a vertically extending portion connecting their respective extending and contracting portions, a liquid chamber formed inside said bellows, a suction port and a discharge port formed in an inner bottom face of said pump body facing said liquid chamber, wherein:

liquid is sucked from said suction port into said liquid chamber by extension of said bellows, and the liquid in said liquid chamber is discharged from said discharge port by contraction of said bellows, said extending and contracting portion of said bellows is formed into a shape in which a lower one of upper and lower lamella portions of each of said ridge-like folds is inclined downwardly toward said vertical axis, not only in an extending state but also in a contracting state, and in the contracting state, the upper lamella portion of each ridge-like fold is formed to be downwardly inclined.

2. The fluid apparatus having a bellows according to claim 1, wherein an inclination angle of said lower lamella portion in the contracting state of each of said ridge-like folds is set to 1 to 45°.

3. The fluid apparatus having a bellows according to claim 1, wherein an inclination angle of said lower lamella portion in the contracting state of each of said ridge-like folds is set to 5 to 15°.

4. A fluid apparatus for a semiconductor producing apparatus having a bellows configured as an accumulator and placed in an accumulator body, said bellows made of polytetrafluoroethylene including extending and contracting portions configured by forming ridge-like folds and valley-like folds in a vertically alternate and continuous manner, which are extendingly and contractingly deformable in an axial direction, said axial direction defining a vertical axis, said ridge-like folds and said valley-like folds having a vertically extending portion connecting their respective extending and contracting portion; a liquid chamber inside said bellows and an air chamber outside said bellows, an inflow port and an outflow port formed in an inner bottom face of said accumulator body facing said liquid chamber; wherein:

a liquid pressure in said liquid chamber balances with an air pressure in said air chamber;

said extending and contracting portion of said bellows is formed into a shape in which a lower one of upper and lower lamella portions of each of said ridge-like folds is inclined downwardly toward said vertical axis, not only in an extending state but also in a contracting state; and in the contracting state, the upper lamella portion of each ridge-like fold is formed to be downwardly inclined.

5. The fluid apparatus having a bellows according to claim 4, wherein an inclination angle of said lower lamella portion in the contracting state of each of said ridge-like folds is set to 1 to 45° C.

6. The fluid apparatus having a bellows according to claim 4, wherein an inclination angle of said lower lamella portion in the contracting state of each of said ridge-like folds is set to 5 to 150.

* * * * *

UNITED STATES PATENT AND TRADEMARK OFFICE

CERTIFICATE OF CORRECTION

PATENT NO. : 6,945,761 B1
APPLICATION NO. : 09/868938
DATED : September 20, 2005
INVENTOR(S) : Nishio et al.

It is certified that error appears in the above-identified patent and that said Letters Patent is hereby corrected as shown below:

Claim 6, column 16, line 45, change “150” to read as --15°--

Signed and Sealed this

First Day of May, 2007

JON W. DUDAS
*Director of the United States Patent and Trademark Office*